US005992987A

United States Patent [19]

Childers et al.

[11] Patent Number: 5,992,987

[45] **Date of Patent: *Nov. 30, 1999**

[54] TECHNIQUE FOR FILLING A PRINT CARTRIDGE WITH INK AND MAINTAINING A CORRECT BACK PRESSURE

[75] Inventors: Winthrop D. Childers; Joseph E. Scheffelin, both of San Diego, Calif.

[73] Assignee: Hewlett-Packard Company, Palo Alto, Calif.

[ * ] Notice: This patent is subject to a terminal disclaimer.

[21] Appl. No.: 08/873,614

[22] Filed: Jun. 11, 1997

Related U.S. Application Data

[63] Continuation of application No. 08/615,936, Mar. 14, 1996, Pat. No. 5,673,073, which is a continuation-in-part of application No. 08/314,978, Sep. 29, 1994, Pat. No. 5,719,610.

[51] Int. Cl.[6] ..... B41J 2/175

[52] U.S. Cl. ..... 347/85

[58] Field of Search ..... 347/86, 87, 85, 347/7

[56] References Cited

U.S. PATENT DOCUMENTS

| | | | |
|---|---|---|---|
| 743,798 | 11/1903 | Allwardt . | |
| 1,150,420 | 8/1915 | Davis et al. . | |
| 1,563,331 | 12/1925 | Bright . | |
| 1,850,879 | 3/1932 | Hunt . | |
| 2,327,611 | 8/1943 | Scheiwer | 285/169 |
| 2,412,685 | 12/1946 | Hoffman et al. | 284/19 |
| 2,612,389 | 9/1952 | MacGlashan, Jr. | 284/19 |
| 2,915,325 | 12/1959 | Foster | 285/276 |
| 3,140,912 | 7/1964 | Davis et al. | 346/140 |
| 3,223,117 | 12/1965 | Curie et al. | 137/556.6 |
| 3,230,964 | 1/1966 | Debrotnic et al. | 251/149.5 |
| 3,339,883 | 9/1967 | Drake | 251/149.4 |
| 3,430,824 | 3/1969 | Conners et al. | 222/523 |
| 3,493,146 | 2/1970 | Conners et al. | 222/153 |
| 3,614,940 | 10/1971 | Abrams et al. | 118/3 |
| 3,777,771 | 12/1973 | De Visscher | 137/1 |
| 3,787,882 | 1/1974 | Fillmore et al. | 346/75 |
| 3,873,062 | 3/1975 | Johnson et al. | 251/149.6 |
| 4,183,031 | 1/1980 | Kyser et al. . | |
| 4,234,885 | 11/1980 | Arway . | |
| 4,412,232 | 10/1983 | Weber et al. . | |
| 4,422,084 | 12/1983 | Saito . | |
| 4,475,116 | 10/1984 | Sicking et al. . | |
| 4,496,959 | 1/1985 | Frerichs . | |
| 4,500,895 | 2/1985 | Buck et al. . | |
| 4,558,326 | 12/1985 | Kimura et al. . | |
| 4,590,494 | 5/1986 | Ichihashi et al. . | |
| 4,591,875 | 5/1986 | McCann . | |
| 4,673,955 | 6/1987 | Ameyama et al. . | |
| 4,677,447 | 6/1987 | Nielsen . | |
| 4,680,696 | 7/1987 | Ebinuma et al. . | |
| 4,689,642 | 8/1987 | Sugitani . | |
| 4,700,205 | 10/1987 | Rich et al. . | |

(List continued on next page.)

FOREIGN PATENT DOCUMENTS

| | | | |
|---|---|---|---|
| 0604712A1 | 7/1994 | European Pat. Off. | B29C 45/16 |
| 59-204569 | 11/1984 | Japan . | |
| 58-81147 | 4/1985 | Japan | B41J 3/04 |

*Primary Examiner*—N. Le
*Assistant Examiner*—Thinh Nguyen

[57] ABSTRACT

A modified syringe for recharging an ink supply in a print cartridge is described. In the preferred embodiment, the end of a syringe valve is inserted into the end of a print cartridge valve to create both a mechanical coupling and a fluid tight coupling between the two valves. A further insertion causes both valves to become open, thus creating an airtight fluid path between the syringe chamber and the depleted print cartridge reservoir. A negative pressure within the print cartridge ink bag draws the ink from the syringe chamber into the ink bag until the ink bag is substantially full and the pressure in the ink bag is at or near atmospheric pressure. An air intake port is provided on the syringe to fill the void left by the ink in the syringe chamber. Once the print cartridge has been recharged, a plunger in the syringe is manually pulled back a predetermined distance to draw an amount of ink out of the print cartridge to create the desired negative pressure in the print cartridge. The syringe is then removed from the print cartridge, automatically pulling the two valves closed.

20 Claims, 19 Drawing Sheets

U.S. PATENT DOCUMENTS

| | | | |
|---|---|---|---|
| 4,703,332 | 10/1987 | Crotti et al. . | |
| 4,714,937 | 12/1987 | Kaplinsky . | |
| 4,777,497 | 10/1988 | Nozu et al. . | |
| 4,940,997 | 7/1990 | Hamlin et al. . | |
| 4,959,667 | 9/1990 | Kaplinsky . | |
| 4,967,207 | 10/1990 | Ruder . | |
| 4,968,998 | 11/1990 | Allen . | |
| 4,973,993 | 11/1990 | Allen . | |
| 4,992,802 | 2/1991 | Dion et al. . | |
| 4,999,652 | 3/1991 | Chan . | |
| 5,008,688 | 4/1991 | Ebinuma et al. . | |
| 5,103,243 | 4/1992 | Cowger . | |
| 5,126,767 | 6/1992 | Asai . | |
| 5,270,739 | 12/1993 | Kitani et al. . | |
| 5,280,300 | 1/1994 | Fong et al. . | |
| 5,283,593 | 2/1994 | Wehl . | |
| 5,343,226 | 8/1994 | Niedermeyeyr et al. | 347/85 |
| 5,365,262 | 11/1994 | Hattori et al. | 347/87 |
| 5,367,328 | 11/1994 | Erickson | 347/7 |
| 5,369,429 | 11/1994 | Erickson | 347/7 |
| 5,425,478 | 6/1995 | Kotaki et al. | 222/501 |
| 5,504,510 | 4/1996 | Miyakawa | 347/85 |
| 5,515,663 | 5/1996 | Allgeier, Sr. et al. | 347/87 |
| 5,673,073 | 9/1997 | Childers et al. | 347/86 |
| 5,675,367 | 10/1997 | Scheffelin et al. | 347/86 |

TECHNIQUE FOR FILLING A PRINT CARTRIDGE WITH INK AND MAINTAINING A CORRECT BACK PRESSURE

CROSS-REFERENCE TO RELATED APPLICATIONS

This application is a continuation of application Ser. No. 08/615,936, filed on Mar. 14, 1996, now U.S. Pat. No. 5,673,073, which is a continuation-in-part of U.S. application Ser. No. 08/314,978, filed Sep. 29, 1994, now U.S. Pat. No. 5,719,610 entitled Method and Apparatus for Regulating Replenishment Ink Flow to a Print Cartridge, by Joseph Scheffelin, incorporated herein by reference.

FIELD OF THE INVENTION

This invention relates to inkjet printers and, more particularly, to a technique for refilling inkjet print cartridges with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

Various types of printers are also known which provide a replaceable ink supply connected to one or more scanning printheads via a flexible ink tube; however, these printers require additional space for the replaceable ink supply, add cost and complexity to the printer, and require the user to disconnect and connect the replaceable ink supply from and to the scanning printheads, which gives rise to air pockets in the ink delivery system.

What is needed is an improved structure and method for recharging the ink supply in an inkjet print cartridge which is not subject to any of the above-mentioned drawbacks of the existing systems.

SUMMARY

An ink printing system is described herein which includes an inkjet printer, a print cartridge having an ink reservoir, an initial fill port, and a refill valve, and an ink refill system for engaging the print cartridge's refill valve and transferring ink to the ink reservoir.

In a preferred embodiment, the ink reservoir in the print cartridge consists of a spring-loaded collapsible ink bag, where the spring urges the sides of the ink bag apart and thus maintains a negative pressure within the ink bag relative to ambient pressure. As the ink is depleted during use of the print cartridge, the ink bag progressively collapses and overcomes the spring force.

A slideable, generally cylindrical ink valve extends through the print cartridge body and into the ink bag. The valve has a male connector portion at its end external to the print cartridge body. The valve is open when pushed into the print cartridge body and closed when pulled away from the print cartridge body.

The ink refill system is a modified syringe containing a supply of ink. In the preferred embodiment, the syringe has a slideable valve with a female connector portion which is engagable with the male connector portion of the print cartridge valve. The syringe valve extends into a syringe chamber containing ink.

To recharge the print cartridge ink reservoir, the end of the syringe valve is inserted into the end of the print cartridge valve to create both a mechanical coupling and a fluid tight coupling between the two valves. A further force causes both valves to be pushed inside their respective ink reservoirs. This further insertion causes both valves to become open, thus creating an airtight fluid path between the syringe chamber and the depleted print cartridge reservoir.

The negative pressure within the print cartridge ink bag draws the ink from the syringe chamber into the ink bag until the ink bag is substantially full and the pressure in the ink bag is at or near atmospheric pressure. An air intake port is provided on the syringe to fill the void left by the ink in the syringe chamber.

Once the print cartridge has been recharged, a plunger in the syringe is manually pulled back a predetermined distance to draw an amount of ink out of the print cartridge to create the desired negative pressure in the print cartridge. The syringe is then removed from the print cartridge. The mechanical coupling initially created between the two valves acts to pull the two valves closed as the syringe is pulled from the print cartridge. Once the two valves are closed, further pulling of the syringe releases the mechanical coupling, and the print cartridge may now be reused.

The print cartridge need not be removed from the printer during recharging. In a preferred embodiment, the syringe contains one recharge for the print cartridge.

DETAILED DESCRIPTION OF THE PREFERRED EMBODIMENTS

Figure 1:
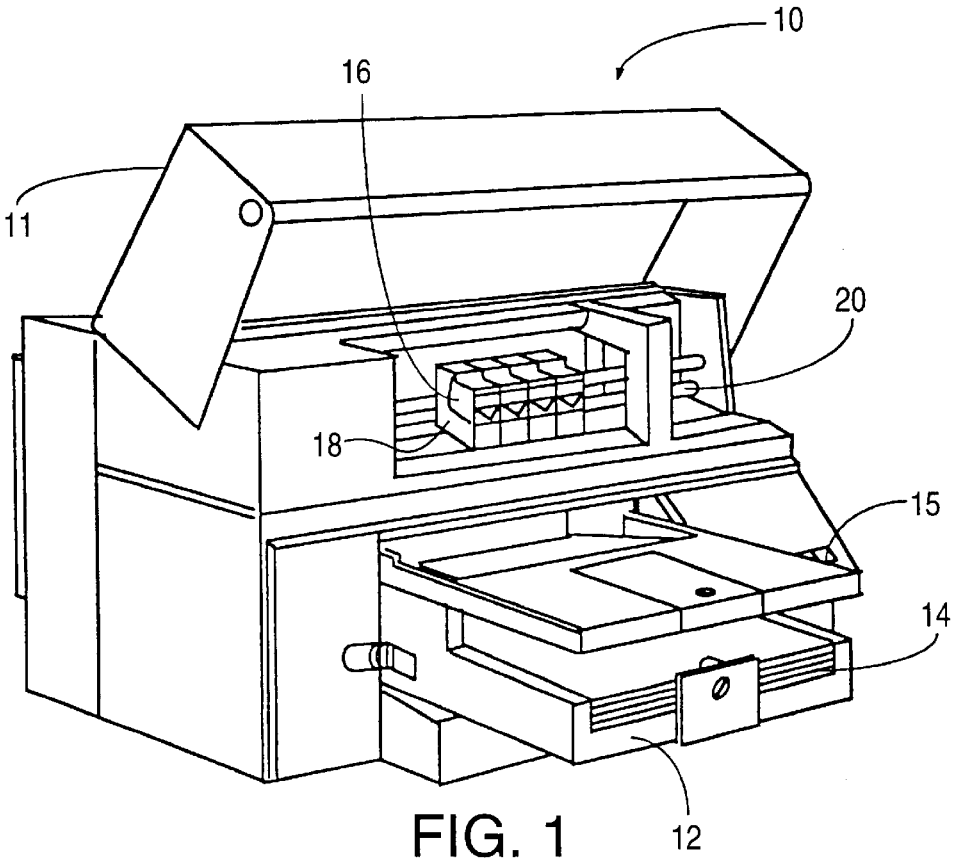
FIG. 1 is a perspective view of an inkjet printer incorporating the preferred embodiment inkjet print cartridge.

FIG. 1 illustrates an inkjet printer 10 incorporating the preferred embodiment rechargeable print cartridge. Inkjet printer 10 itself may be conventional. A cover 11 protects the printing mechanism from dust and other foreign objects. A paper input tray 12 supports a stack of paper 14 for printing thereon. The paper, after printing, is then deposited in an output tray 15.

Description of Print Cartridge 16

In the embodiment shown in FIG. 1, four print cartridges 16 are mounted in a scanning carriage 18. Print cartridges 16 contain black, cyan, magenta, and yellow ink, respectively. Selective activation of the ink firing elements in each of the four print cartridges 16 can produce a high resolution image in a wide variety of colors. In one embodiment, the black inkjet print cartridge 16 prints at 600 dots per inch (dpi), and the color print cartridges 16 print at 300 dpi.

The scanning carriage 18 is slideably mounted on a rod 20, and carriage 18 is mechanically scanned across the paper, using a well-known belt/wire and pulley system, while print cartridges 16 eject droplets of ink to form printed characters or other images. Since the mechanisms and electronics within printer 10 may be conventional, printer 10 will not be further described in detail.

Figure 2:
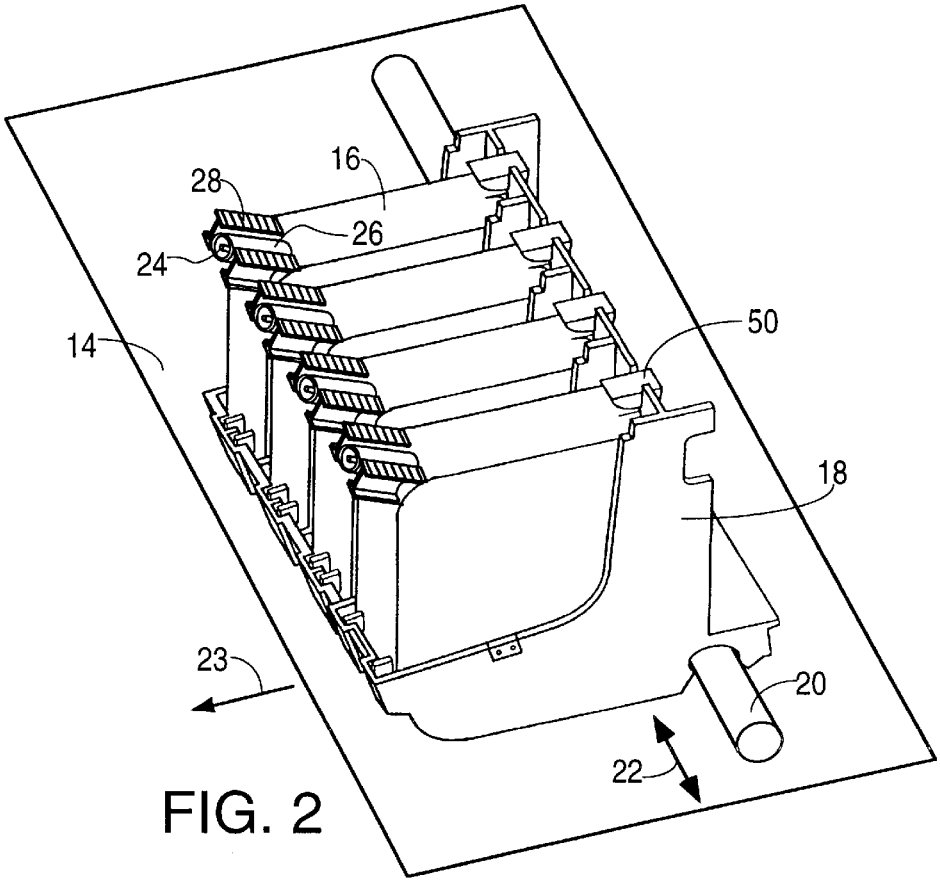
FIG. 2 is a perspective view of the preferred embodiment print cartridge being supported by a scanning carriage in the printer of FIG. 1.

FIG. 2 is a more detailed view of the scanning carriage 18 housing print cartridges 16. Carriage 18 moves in the direction indicated by arrow 22, and a sheet of paper 14 moves in the direction of arrow 23 perpendicular to the direction of movement of carriage 18.

Each print cartridge 16 is removable and engages with fixed electrodes on carriage 18 to provide the electrical signals to the printheads within each of print cartridges 16.

Each of print cartridges 16 contains a valve 24 which may be opened and closed. In an open state, ink from an external ink supply may flow through valve 24 and into the ink reservoir within print cartridge 16. Valve 24 is surrounded by a cylindrical plastic sleeve 26, which generally forms part of a handle 28 for allowing the user to easily grasp print cartridge 16 for insertion into and removal from carriage 18.

Additional detail regarding carriage 18 is found in U.S. Pat. No. 5,408,746, entitled "Datum Formation for Improved Alignment of Multiple Nozzle Members in a Printer," by Jeffrey Thoman, et al., assigned to the present assignee and incorporated herein by reference.

Figure 3:
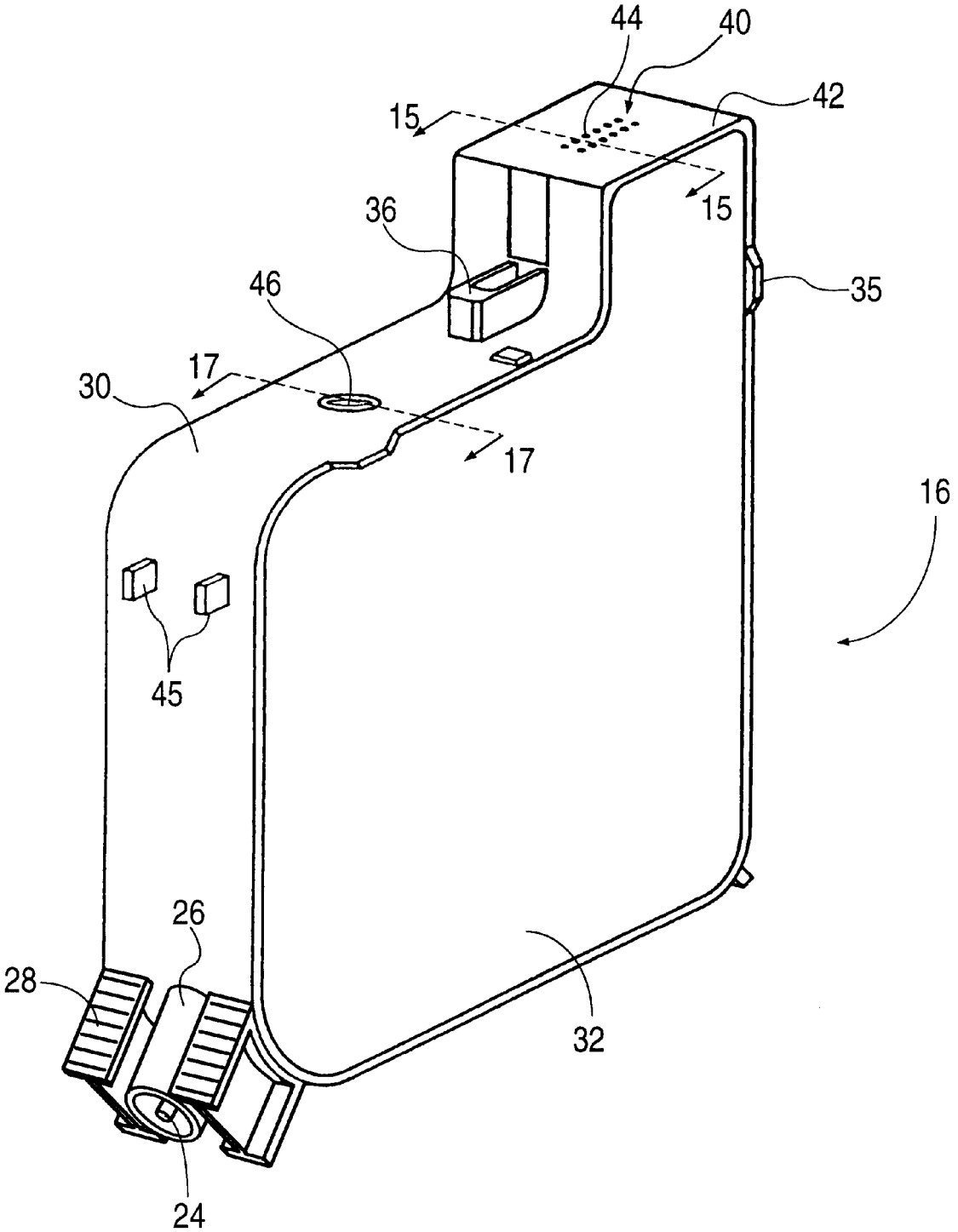
FIG. 3 is a perspective view of the preferred embodiment print cartridge incorporating a refill valve.

FIG. 3 shows one perspective view of the preferred embodiment print cartridge 16. Elements labeled with the same numerals in other figures are identical. The outer frame 30 of print cartridge 16 is formed of molded engineering plastic, such as the material marketed under the trademark "NORYL" by General Electric Company. Side covers 32 may be formed of metal or plastic. Datums 34, 35, and 36 affect the position of print cartridge 16 when installed in carriage 18. Datums 34, 35, and 36 are machined after the nozzle member 40 has been installed on a print cartridge 16 to ensure that all four print cartridges 16 have their respective nozzles aligned with each other when inserted into carriage 18. Additional detail regarding the formation of datums 34, 35, and 36 can be found in U.S. Pat. No. 5,408,746, entitled "Datum Formation for Improved Alignment of Multiple Nozzle Members in a Printer," previously mentioned.

In the preferred embodiment, nozzle member 40 consists of a strip of flexible tape 42 having nozzles 44 formed in the tape 42 using laser ablation. One method for forming such nozzles 44 is described in U.S. Pat. No. 5,305,015, entitled "Laser Ablated Nozzle Member for Inkjet Printhead," by Christopher Schantz et al., assigned to the present assignee and incorporated herein by reference. The structure of this nozzle member 40 will be described in greater detail later.

Plastic tabs 45 are used to prevent a particular print cartridge 16 from being inserted into the wrong slot in carriage 18. Tabs 45 are different for the black, cyan, magenta, and yellow print cartridges.

A fill hole 46 is provided for initially filling the ink reservoir in print cartridge 16 by the manufacturer. This hole 46 is later sealed with a steel ball, which is intended to be permanent. Such filling will be described later.

Figure 4:
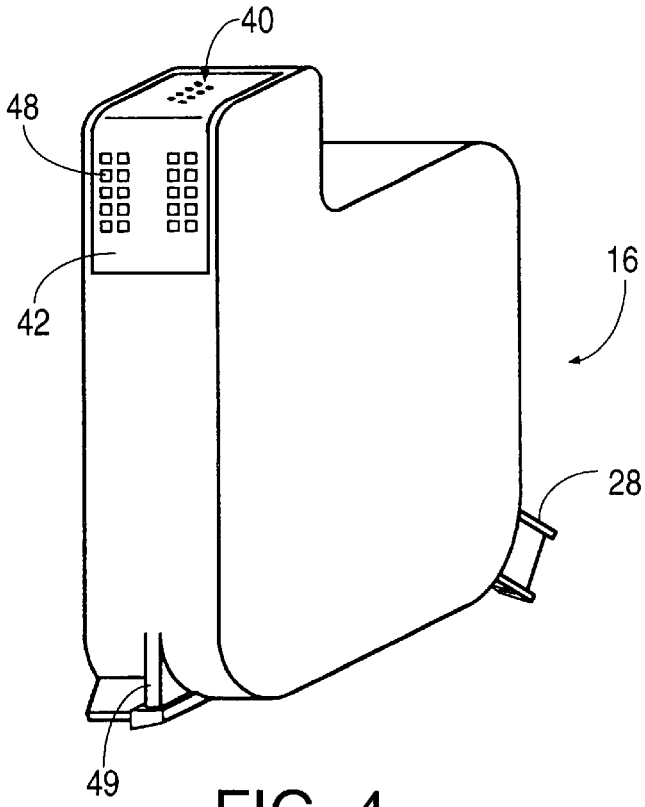
FIG. 4 is a different perspective view of the print cartridge of FIG. 3.

FIG. 4 is another perspective view of print cartridge 16 showing electrical contact pads 48 formed on the flexible tape 42 and connected via traces, formed on the underside of tape 42, to electrodes on the printhead substrate affixed to the underside of tape 42.

A tab 49 engages a spring-loaded lever 50 (FIG. 2) on carriage 18 for locking print cartridges 16 in place in carriage 18.

Figure 5:
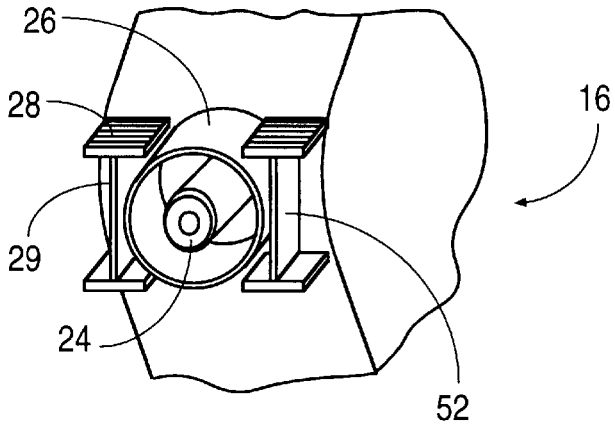
FIG. 5 is a close-up view of the refill valve on the print cartridge of FIG. 3.

FIG. 5 is a close-up of the print cartridge valve 24 surrounded by the cylindrical sleeve 26, forming part of handle 28. Support flanges 52 provide added support for handle 28.

Figure 6:
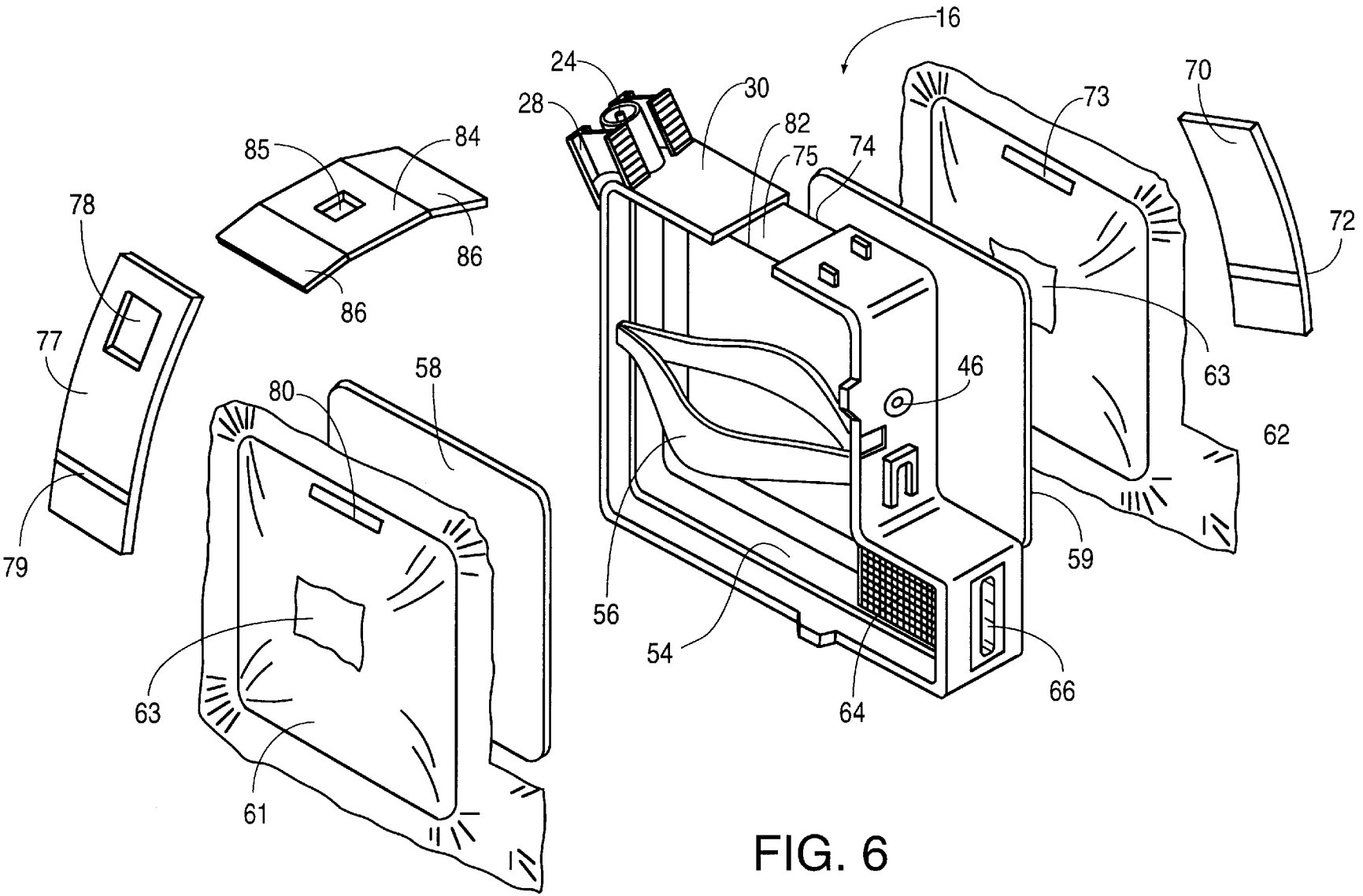
FIG. 6 is an exploded view of the print cartridge of FIG. 3 without side covers.

FIG. 6 is an exploded view of print cartridge 16 of FIG. 3 without side covers 32. FIG. 6 shows the construction of the collapsible ink bag 51, shown assembled in FIG. 7, which provides a negative internal pressure relative to atmospheric pressure. The construction of ink bag 51 is as follows.

A plastic inner frame 54 is provided which generally has the same contours as the rigid outer frame 30. Inner frame 54 is preferably formed of a plastic which is more flexible than that used to form outer frame 30 and has a lower melting temperature. A suitable plastic material is a soft polyolefin alloy. In the preferred embodiment, outer frame 30 is used as a portion of the mold when forming inner frame 54. Additional detail regarding the formation of frame 30 and frame 54 is found in U.S. application Ser. No. 07/994,807, filed Dec. 22, 1992, now U.S. Pat. No. 5,515,092 entitled "Two Material Frame Having Dissimilar Properties for a Thermal Ink-Jet Cartridge," by David Swanson, assigned to the present assignee and incorporated herein by reference.

A bow spring 56 is provided, which may be cut from a strip of metal such as stainless steel. The apexes of the bight portions of bow spring 56 are spot welded or laser welded to a central portion of rigid metal side plates 58 and 59. A pair of flexible ink bag sidewalls 61 and 62, formed of a plastic such as ethylene vinyl acetate (EVA) or Mylar, have their peripheral portions heat welded to the edges of inner frame 54 to provide a fluid seal and have their central portions 63 heat welded to side plates 58 and 59. The preferred sidewalls 61 and 62 are formed of a flexible nine-layer material described in U.S. Pat. No. 5,450,112, incorporated herein by reference.

The ink bag sidewalls 61 and 62 now oppose side plates 58 and 59 so as to pretension bow spring 56. Bow spring 56 now acts as a pressure regulator to provide a relatively constant outward force on the ink bag sidewalls 61 and 62 to provide a negative pressure on the order of −0.1 psi within ink bag 51 (equivalent to a relative pressure of about −3 inches of water). An acceptable negative pressure is in the range of approximately −1 to −7 inches of water, with the preferred range being −3 to −5 inches of water.

The actual negative pressure required of ink bag 51 is based on various factors, including the nozzle orifice architecture, the geometry of print cartridge 16 (including the outer expansion limits of ink bag 51 as determined by the thickness of print cartridge 16), and the horizontal/vertical orientation of print cartridge 16 when mounted in a printing position in carriage 18.

As ink is withdrawn from print cartridge 16, ink bag 51 (FIG. 7) will collapse.

An edge guard may optionally be bonded to the surface of metal side plates 58 and 59 to prevent the metal edges of plates 58 and 59 from contacting and tearing the ink bag sidewalls 61 and 62. This edge guard may be a thin plastic cover layer adhesively secured to the outer face of side plates 58 and 59 and slightly overlapping the edges.

A mesh filter 64 is also provided on inner frame 54 within ink bag 51 to filter out particles prior to the ink reaching the primary ink channel 66 formed in the snout portion of outer frame 30. A printhead assembly will later be secured to the snout portion of print cartridge 16, and ink channels in the printhead assembly will lead from the primary ink channel 66 into ink ejection chambers on the printhead.

Figure 7:
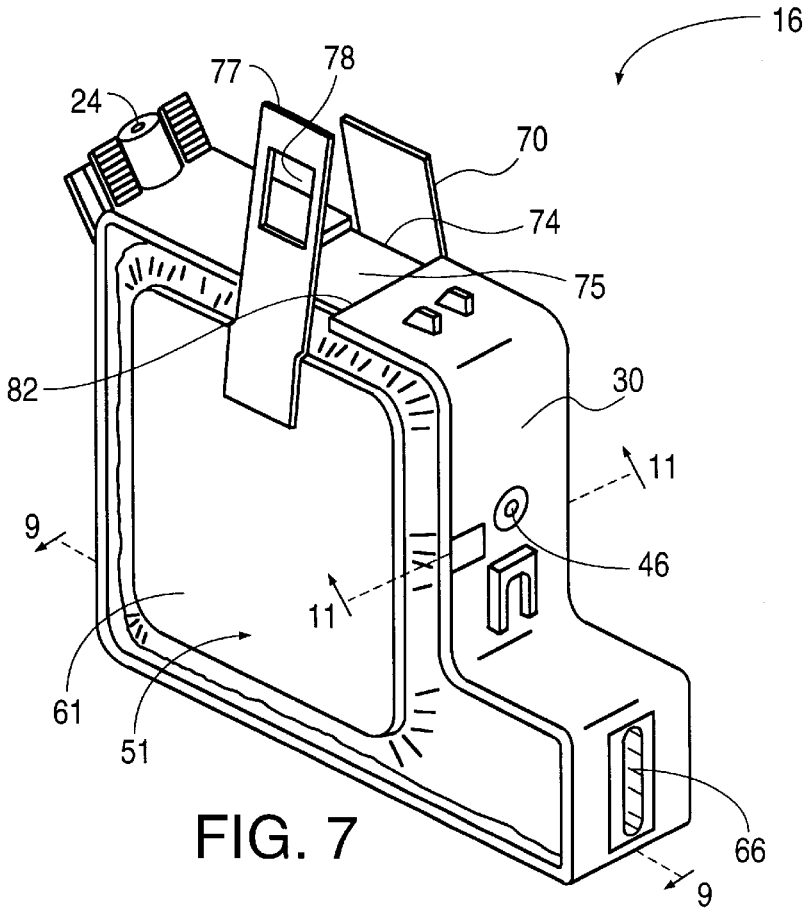
FIG. 7 is a perspective view of the print cartridge of FIG. 6 after assembly and prior to side covers being connected.

Ink bag 51 also includes a slideable valve 24, to be discussed in detail later. Ink bag 51 is thus now completely sealed except for the opening for the primary ink channel 66. FIG. 7 shows the structure of FIG. 6 prior to side covers being placed on print cartridge 16.

In the preferred embodiment, the amount of ink remaining in ink bag 51 is ascertained by means of an ink level detector, illustrated in FIGS. 6 and 7, formed as follows. A first paper strip 70 of a solid color, such as green, is secured to ink bag sidewall 62 via an adhesive 72 connected to area 73 on sidewall 62. The end of this strip 70 is then bent over the recessed edge 74 of frame 30 and lies flat against recessed surface 75 of frame 30. A strip 77 of a different color, such as black, is provided with a window 78. An adhesive 79 on strip 77 is then secured to sidewall 61 at area 80. Strip 77 is bent over the recessed edge 82 of frame 30 and now overlies solid strip 70 on the recessed surface 75. Once the side plates 32 (FIG. 3) are secured to print cartridge 16, a strip 84 having a transparent window 85, which may be a hole or a clear portion, is then secured over the recessed surface 75 by adhesively securing edges 86 to the respective side covers 32 on print cartridge 16. As the flexible ink bag sidewalls 61 and 62 become closer together as ink is depleted from the ink bag 51, the window 78 in strip 77 will expose less and less of the color of strip 70, as seen through window 85, until the green color of strip 70 is no longer exposed through window 85 and only the black strip 77 appears through window 85. Print cartridge 16 must then be recharged using valve 24 in the method described later.

Figure 8:
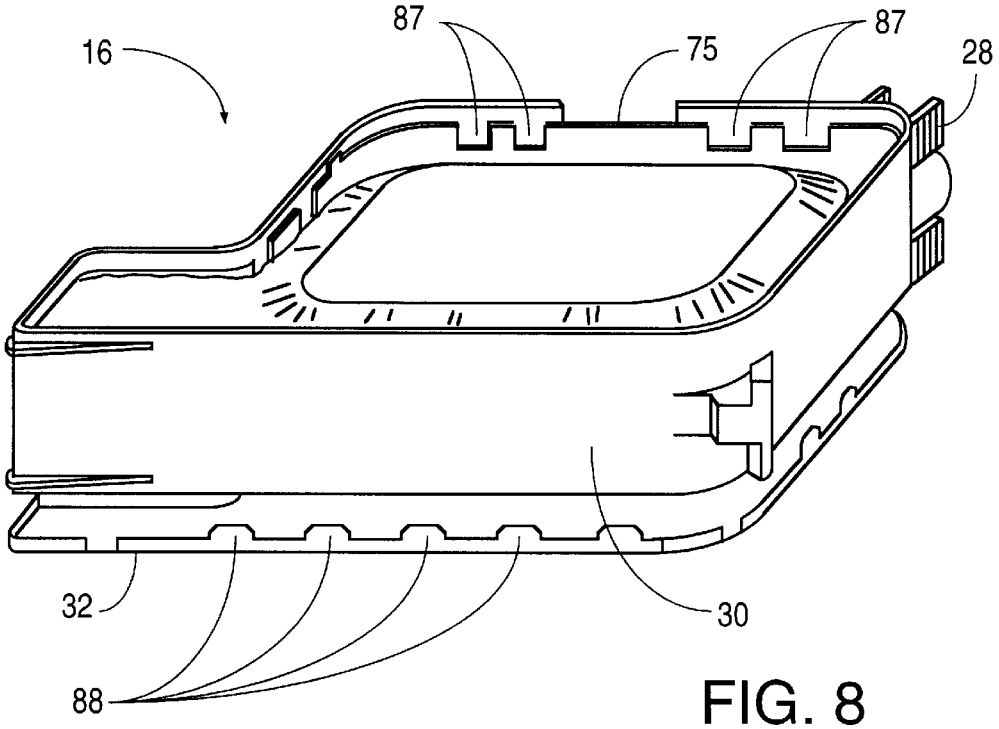
FIG. 8 is a perspective view of the print cartridge of FIG. 7 showing a side cover being connected.

FIG. 8 illustrates in greater detail one rigid side cover 32 and its method of being secured to the print cartridge outer frame 30. Slots 87 are shown formed in outer frame 30 which align with tabs 88 formed in side covers 32. Tabs 88, when inserted into slots 87, provide secure placement of the side covers 32 on frame 30. Preferably, tabs 88 slightly cut into the plastic forming the sides of slots 87 to form a high friction attachment of the side covers 32 to frame 30. Optionally, an adhesive may also be used to secure side covers 32 to frame 30.

Figure 9:
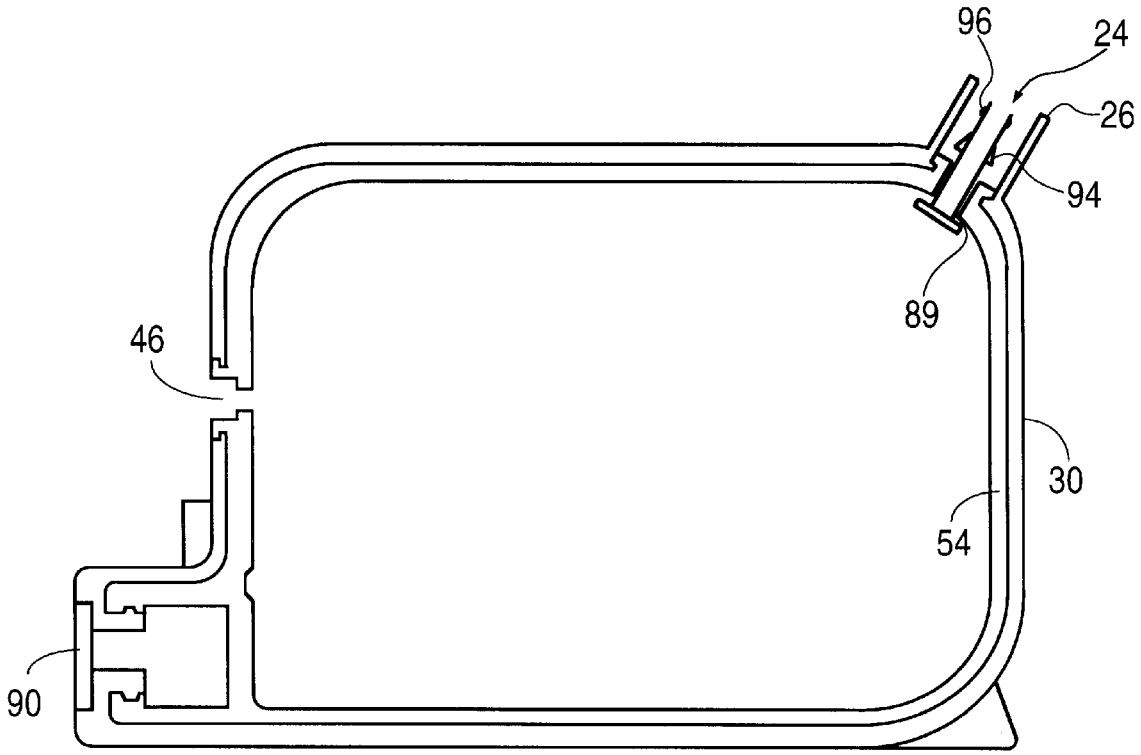
FIG. 9 is a cross-sectional view of the print cartridge of FIG. 7 taken along line 9—9 in FIG. 7.

FIG. 9 is a cross-sectional view of the outer frame 30 and inner frame 54 portion of print cartridge 16 along line 9—9 in FIG. 7, essentially bisecting the print cartridge 16. Valve 24 is shown in its closed position along with a cross-section of the cylindrical sleeve 26. Upon injection molding inner frame 54 using outer frame 30 as a partial mold, a fluid tight valve seal 89 is formed through which slideable valve 24 is inserted. Valve 24 may be formed of low density polyethylene (LDPE), Teflon™, or other suitable material. Also shown in the cross-section of FIG. 9 is ink fill port 46. A simplified portion of a printhead substrate 90 is also shown.

Figure 10A:
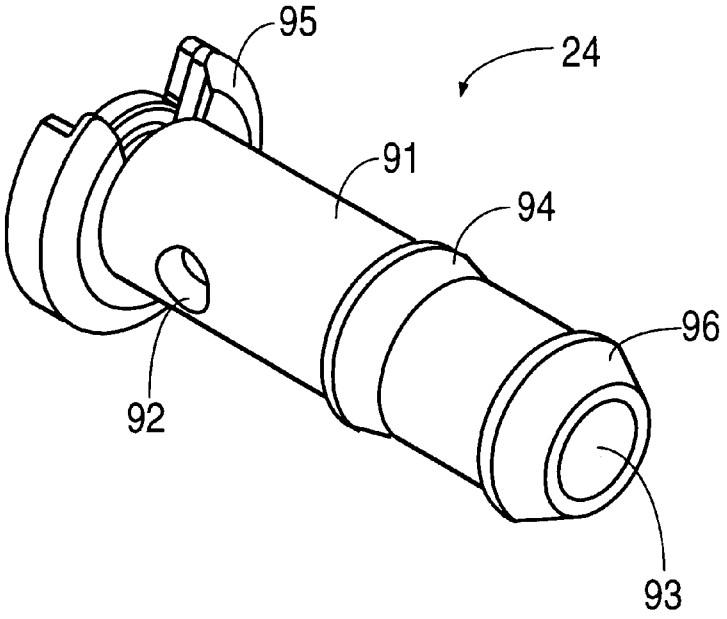
FIGS. 10A and 10B are perspective views of the slideable value used in the print cartridge of FIG. 7.
Figure 10B:
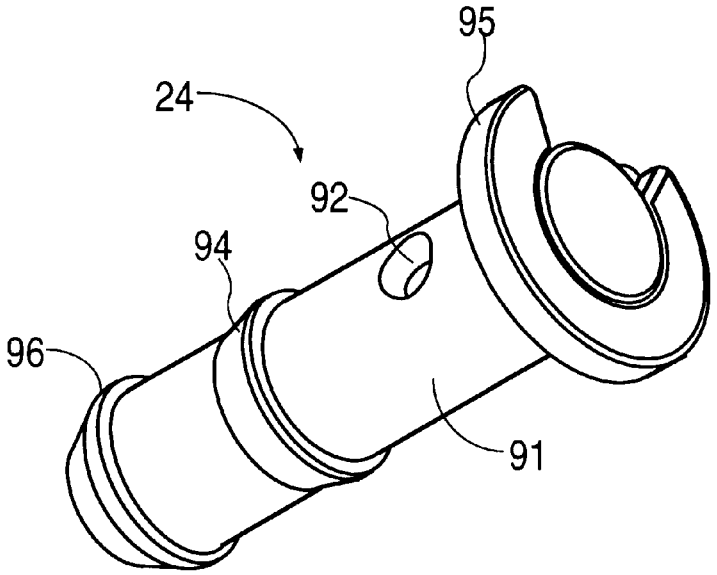

Additional detail of valve 24 is shown in FIGS. 10A and 10B. In the preferred embodiment, valve 24 consists of a hollow shaft portion 91 having a hole 92 formed in the side of shaft portion 91 and an opening 93 in the top of shaft portion 91. A first rib 94 limits the downward travel of valve 24 into the print cartridge body. A clip 95 is resiliently secured to the end of shaft portion 91 around an annular notch formed in shaft portion 91 to limit the upward travel of valve 24 out of the print cartridge body. Clip 95 may be formed of high density polyethylene (HDPE), polycarbonate, or other suitable material. An annular rib 96 is formed near the top of valve 24 which seats within a recess in a valve (to be described later) in an axillary ink reservoir. In the preferred embodiment, the length of valve 24 is 0.582 inches; however, an acceptable range may be approximately 0.25 to 1.0 inch depending on design factors such as ergonomics and reliability. The outer diameter of valve 24 is approximately 0.154 inches, but can be virtually any diameter.

Figure 11:
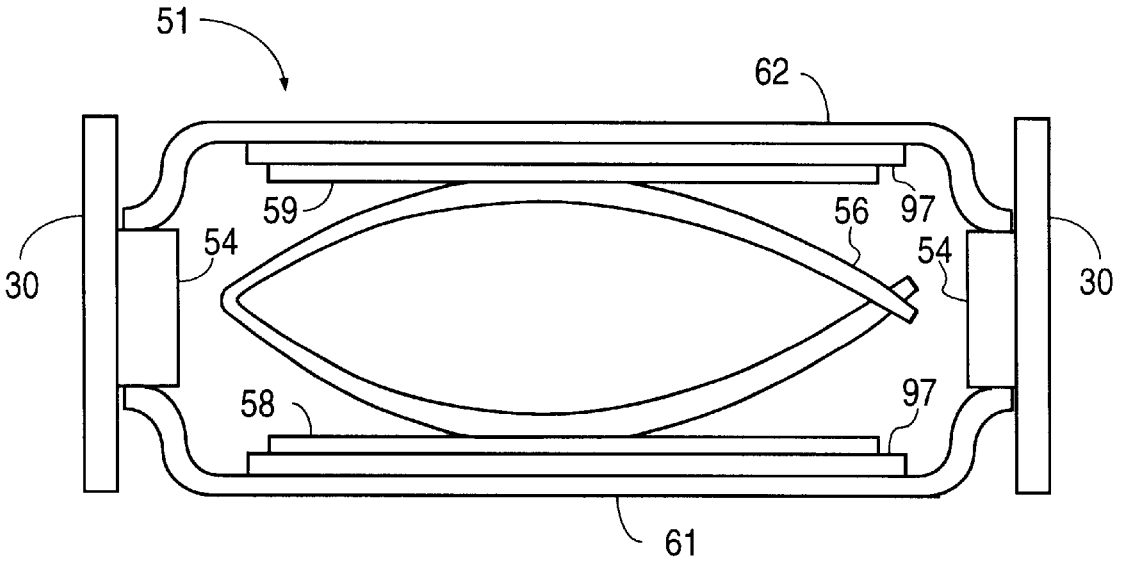
FIG. 11 is a cross-sectional view of the print cartridge of FIG. 7 taken along line 11—11 in FIG. 7.

FIG. 11 is a cross-sectional view of the structure of FIG. 7 taken along line 11—11 showing bow spring 56, flexible ink bag sidewalls 61 and 62, metal side plates 58 and 59, and optional protective edge guards 97. Spring 56 is pretensioned so that the spring force remains fairly constant as ink bag 51 collapses.

Additional information regarding the construction of the spring-loaded ink bag can be found in U.S. application Ser. No. 08/454,975, filed May 31, 1995, now U.S. Pat. No. 5,745,137, entitled "Continuous Refill of Spring Bag Reservoir in an Ink-Jet Swath Printer/Plotter," by Joseph Scheffelin et al., assigned to the present assignee and incorporated herein by reference.

Other suitable negative pressure ink reservoirs include a plastic bellows, an ink bag have an external spring, a reservoir having an external pressure regulator, and a rigid reservoir whose internal pressure is regulated by a bubble source.

Figure 12:
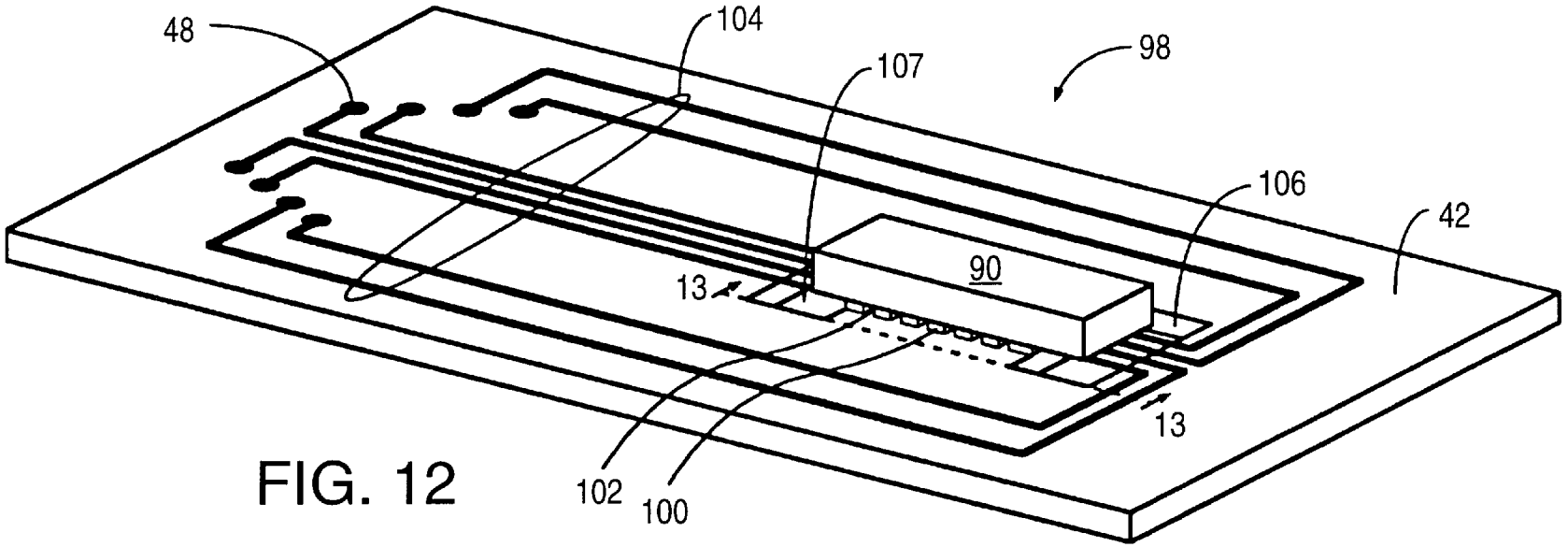
FIG. 12 is a perspective view of the back of a printhead assembly containing a printhead substrate mounted on a flexible tape and ink ejection nozzles formed in the tape, where electrodes on the substrate are bonded to conductive traces formed on the tape.

The printhead assembly will now be described. FIG. 12 shows a back surface of the printhead assembly 98 showing a silicon substrate 90 mounted to the back of a flexible tape 42. Printhead assembly 98 is ultimately affixed to the print cartridge 16 body as shown in FIG. 4 by heat staking. Tape 42 may be formed of a polyimide or other plastic. One edge of a barrier layer 100 formed on substrate 90 is shown containing ink channels 102 and ink ejection chambers, to be described later. The ink ejection chambers may also be referred to as vaporization chambers if the printhead is a thermal type.

Conductive traces 104 are formed on the back of tape 42 using a conventional photolithographic or plating process, where traces 104 terminate in contact pads 48, previously mentioned with respect to FIG. 4. The other ends of traces 104 connect to electrodes 108 (FIG. 13) on substrate 90. Windows 106 and 107 formed in tape 42 are used to gain access to the ends of traces 104 to bond these ends to the electrodes 108 on substrate 90.

Figure 13:
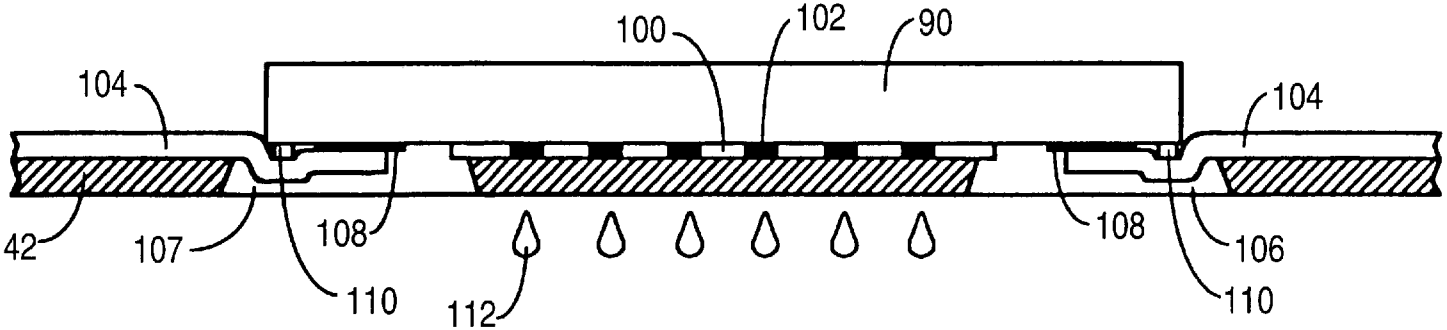
FIG. 13 is a cross-sectional view of the structure of FIG. 12 taken along line 13—13 in FIG. 12.

FIG. 13 shows a side view cross-section taken along line 13—13 in FIG. 12 illustrating the connection of the ends of the conductive traces 104 to electrodes 108 on substrate 90. As seen in FIG. 13, a portion 110 of barrier layer 100 is used to insulate the ends of the conductive traces 104 from substrate 90. Droplets of ink 112 are shown being ejected through nozzles formed in tape 42 after ink ejection elements associated with each of the nozzles are energized.

Figure 14:
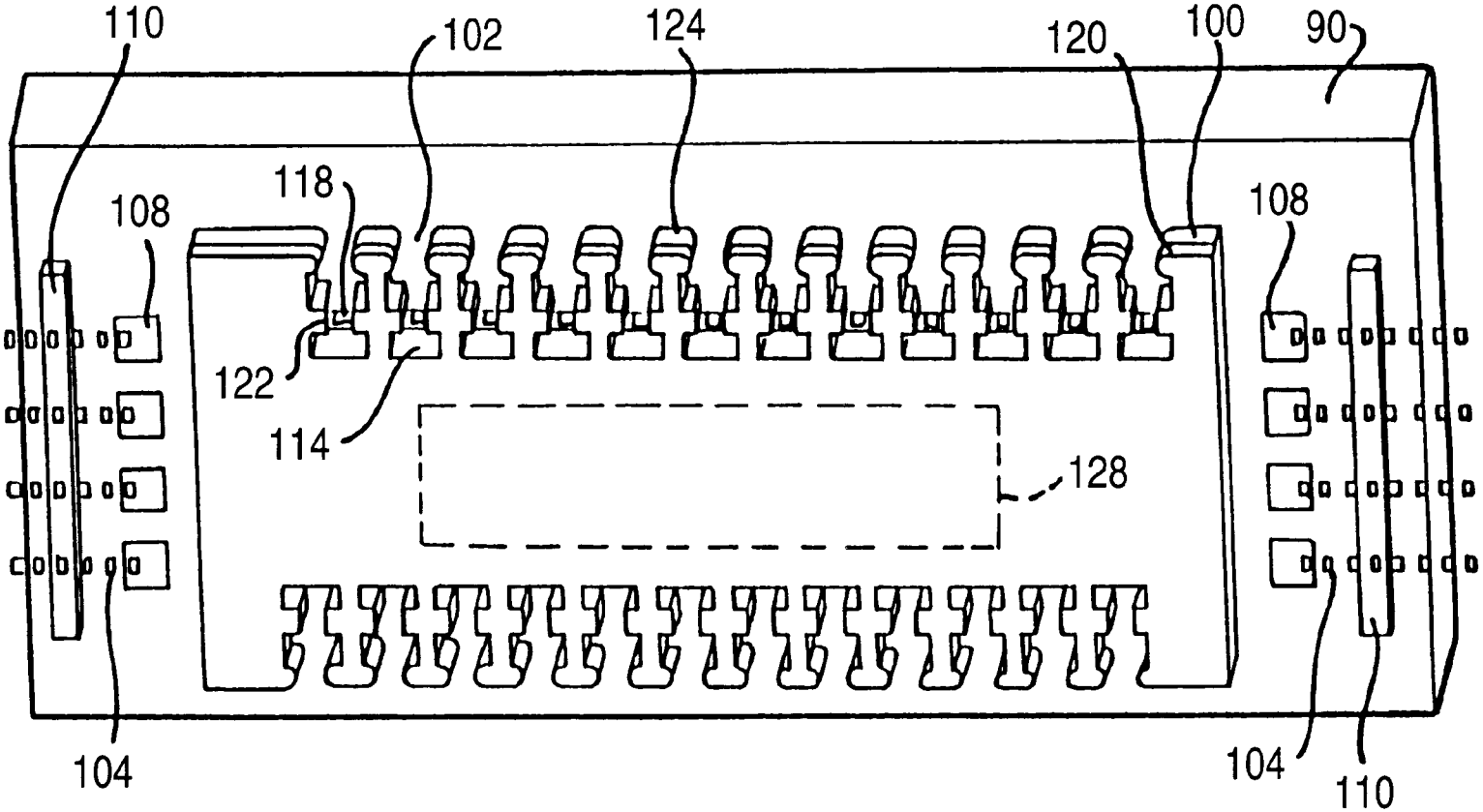
FIG. 14 is a perspective view of the printhead substrate showing the various ink ejection chambers and ink ejection elements formed on the substrate.

FIG. 14 is a simplified perspective view of substrate 90 containing ink ejection chambers 114, ink channels 102 leading to each ink ejection chamber 114, and ink ejection elements 118, which, in the preferred embodiment, are heater resistors. In an alternative embodiment, ink ejection elements 118 are piezoelectric elements. Barrier layer 100 in the preferred embodiment is a photoresist, such as Vacrel or Parad, and formed using conventional photolithographic techniques. An adhesive layer 126 is formed over barrier layer 100 to adhesively secure substrate 94 to the back of tape 42.

Constriction points 122 provide viscous damping during refill of ink ejection chambers 114 after firing. The enlarged areas 124 at the entrance way to each ink channel 102 increase the support area at the edges of barrier layer 100 so that the portion of tape 42 containing nozzles lies relatively flat on barrier layer 100 when affixed to barrier layer 100. Two adjacent enlarged areas 124 also act to constrict the entrance of the ink channels 102 so as to help filter large foreign particles.

Electrodes 108 are shown connected to phantom traces 104 after substrate 90 is affixed to tape 42 as previously described. Barrier portions 110 insulate traces 104 from the substrate 90 surface. Other embodiments of ink ejection chambers may also be used. In the preferred embodiment, the ink ejection chambers 114 are spaced to provide a print resolution of 600 dpi.

Circuitry on substrate 90 is represented by demultiplexer 128. Demultiplexer 128 is connected to electrodes 108 and distributes the electrical signals applied to electrodes 108 to the various ink ejection elements 118 in a way such that there are less electrodes 108 required than ink ejection elements 118. In the preferred embodiment, groups of ink ejection elements 118 are repeated, each group being referred to as a primitive. Addressing lines connected to electrodes 108 address one ink ejection element 118 at a time in each of the primitives. By requiring both the primitive to be addressed and a particular ink ejection element 118 in a primitive to be addressed at the same time, the number of electrodes 108 on substrate 90, and the number of contact pads 48 (FIG. 4) on a print cartridge 16, can be much less (e.g., 52) than the total number of ink ejection elements 118 (e.g., 300).

Additional information regarding this particular printhead structure may be obtained from U.S. application Ser. No. 08/319,896, filed Oct. 6, 1994, now U.S. Pat. No. 5,648,865, entitled "Inkjet Printhead Architecture for High Speed and High Resolution Printing," by Brian Keefe et al., assigned to the present assignee and incorporated herein by reference.

Figure 15:
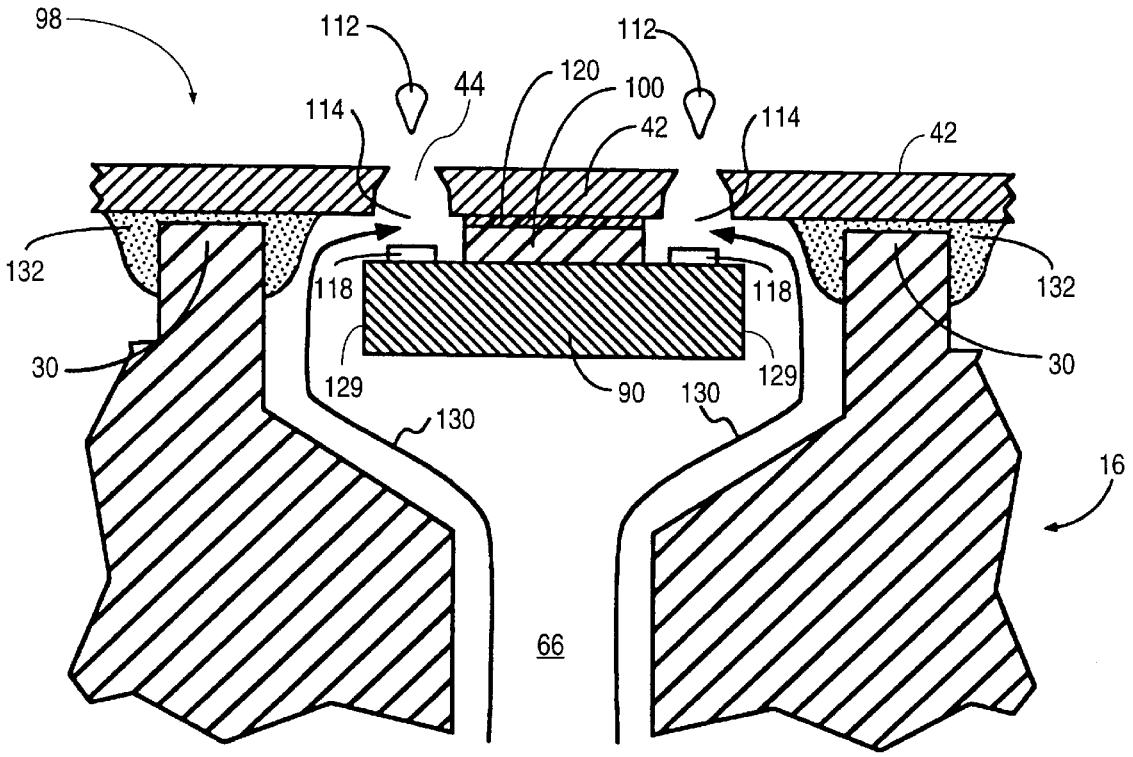
FIG. 15 is a cross-sectional view of the print cartridge of FIG. 3 taken along line 15—15 in FIG. 3 showing the feeding of ink around the outer edges of the substrate and into the ink ejection chambers.

FIG. 15 is a cross-sectional view along lines 15—15 in FIG. 3 showing ink being delivered from the collapsible ink bag 51 through primary ink channel 66 (also shown in FIG. 7), around the outer edges 129 of substrate 90 and into the ink channels 102 (FIG. 14) and ink ejection chambers 114. The path of ink is shown by arrows 130. Tape 42 having nozzles 44 formed therein is sealed around primary ink channel 66 by an adhesive 132.

Figure 16:
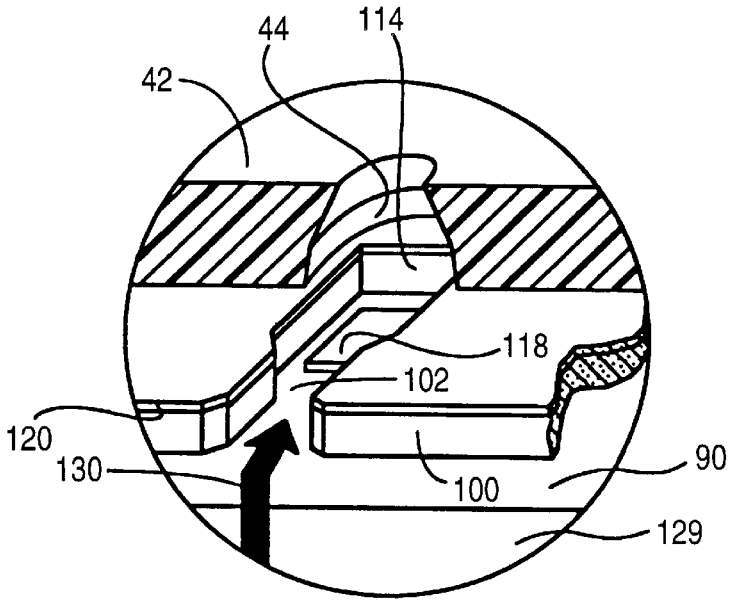
FIG. 16 is a partial cross-sectional view of the edge of the substrate and the flexible tape showing the delivery of ink around the edge of the substrate and into an ink ejection chamber.

FIG. 16 shows a close-up partial cross-section of the printhead assembly 98 showing a nozzle 44, a simplified ink ejection chamber 114, and various other elements making up the printhead assembly 98 described with respect to FIGS. 12–14. As seen, the ink path 130 flows around an outer edge 129 of substrate 90.

Figure 17:
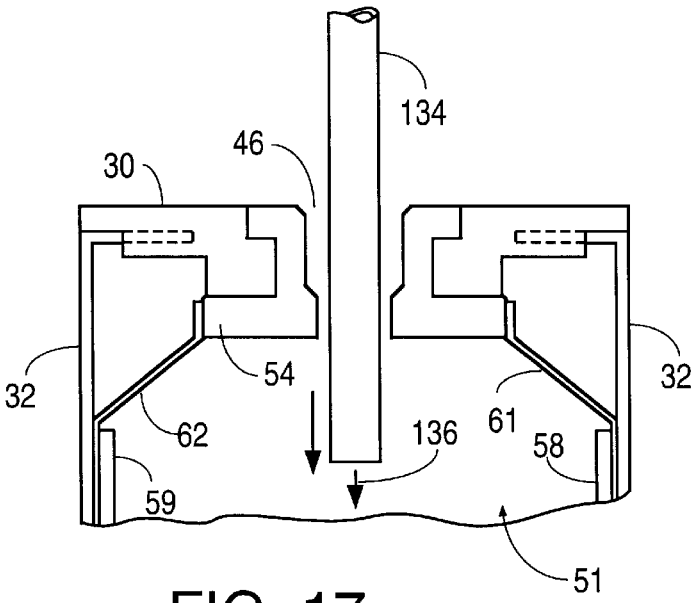
FIG. 17 is a partial cross-sectional view of the print cartridge of FIG. 3 taken along line 17—17 in FIG. 3 illustrating the initial filling of the print cartridge reservoir with ink.
Figure 18:
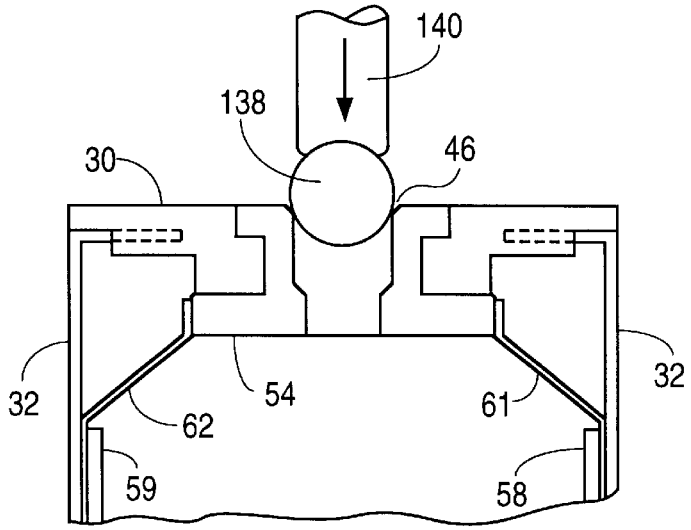
FIGS. 18 and 19 illustrate the insertion of a steel ball in the fill hole shown in FIG. 17 for permanently sealing the fill hole.
Figure 19:
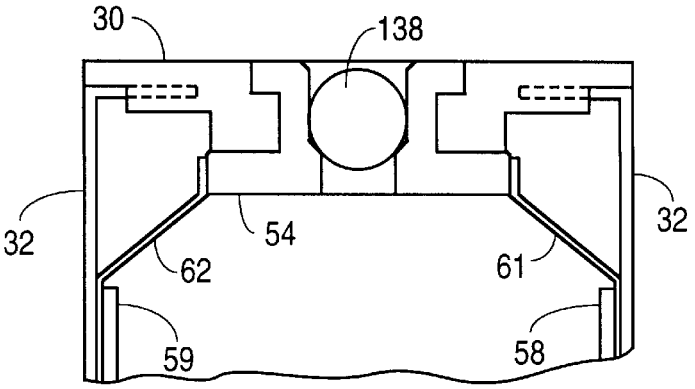

FIGS. 17–19 illustrate the preferred method of initially filling print cartridge 16 with ink through ink fill hole 46, best shown in FIG. 3. FIGS. 17–19 are taken along line 17—17 in FIG. 3 and show outer frame 30, side covers 32, inner frame 54, flexible ink bag sidewalls 61 and 62, and metal side plates 58 and 59. In a first step, the air in ink bag 51 is replaced with $CO_2$ by simply injecting $CO_2$ through ink fill hole 46. As described later, the $CO_2$ helps prevent air bubbles from forming in ink bag 51 after filling with ink. An ink delivery pipe 134 is then inserted through ink fill hole 46, and ink 136 is pumped into the empty ink bag 51 until the ink reaches fill hole 46. In the preferred method, pipe 134 is inserted to near the bottom of ink bag 51 to minimize ink splashing and the creation of foam.

Once ink bag 51 is full, a stainless steel ball 138 (FIG. 18) is pressed into ink fill hole 46 by a plunger 140 until the ball 138 is seated and firmly secured in fill hole 46, as shown in FIG. 19. Ball 138 is now intended to permanently seal ink fill hole 46, and any recharging of the ink in ink bag 51 will be performed via valve 24 in FIG. 3.

Print cartridge 16 is then positioned such that its snout is at the highest point, and any excess air is withdrawn through nozzles 44 using a vacuum pump sealed with respect to nozzles 44. A sufficient amount of ink is then sucked through nozzles 44 to create the initial negative pressure in ink bag 51 equivalent to about −3 to −4 inches of water. Due to the small diameter of nozzles 44 and the narrow width of the various ink channels, coupled with the ink viscosity, the negative pressure within ink bag 51 does not draw air through nozzles 44. In the preferred embodiment, the capacity of ink bag 51 is around 50 milliliters.

The completed print cartridge 16 is then used in the printer of FIG. 1 in a conventional manner, and ink bag 51 becomes progressively depleted, starting from an expanded state to a compressed state, all the time maintaining a negative pressure in ink bag 51.

Description of Ink Refill System

Figure 20:
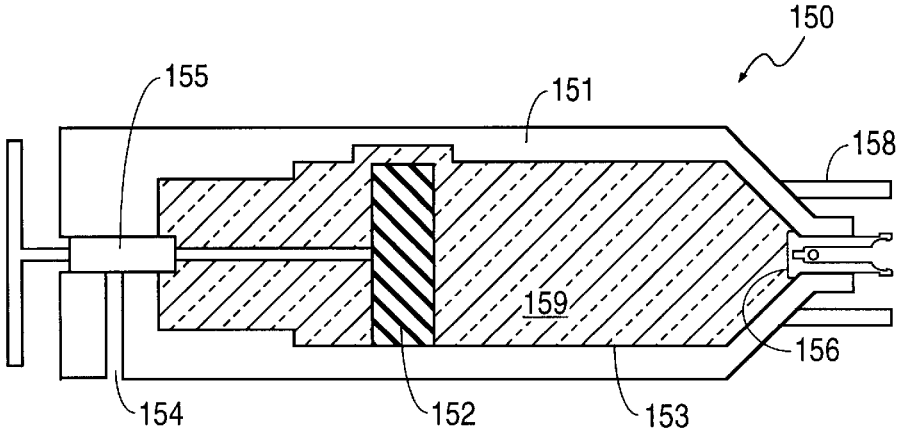
FIG. 20 is a cross-sectional view of the preferred syringe type ink refill system in its initial state.

FIG. 20 is a cross-sectional view of one embodiment of the ink refill system in the form of a syringe 150. Syringe 150 is preferably adapted to connect to valve 24 (FIG. 3) on print cartridge 16 so as to recharge ink bag 51 in print cartridge 16 without any ambient air ingestion into ink bag 51. In the preferred embodiment, syringe 150 is cylindrical, and the cross-section of FIG. 20 is a bisected view along the major axis of the syringe 150.

Syringe 150 consists of an external body 151, which is preferably a transparent or translucent plastic, and a plunger 152 having a limited range of movement within an ink chamber 153. An air hole 154 communicates with ink chamber 153 when a simple valve 155 is opened to create a path between air hole 154 and chamber 153.

A slideable valve 156, shown in a closed state, creates an airtight fluid connection to valve 24 on print cartridge 16 when properly connected. A cylindrical sleeve 158 surrounds valve 156 and provides support for syringe 150 when connected to print cartridge 16.

Syringe 150 will normally be provided having an initial supply of ink 159 in its chamber 153, although it is also envisioned that syringe 150 may be refillable from an external ink reservoir for multiple uses.

Figure 21A:
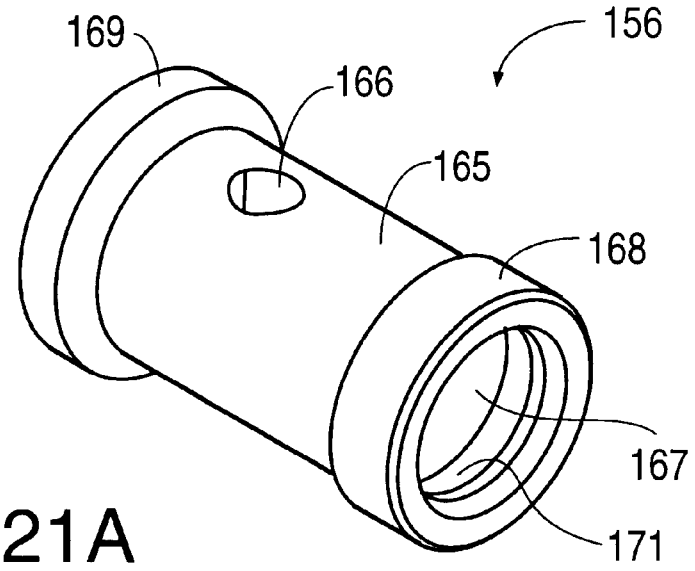
FIGS. 21A and 21B are perspective views of the slideable valve used in the preferred syringe system.
Figure 21B:
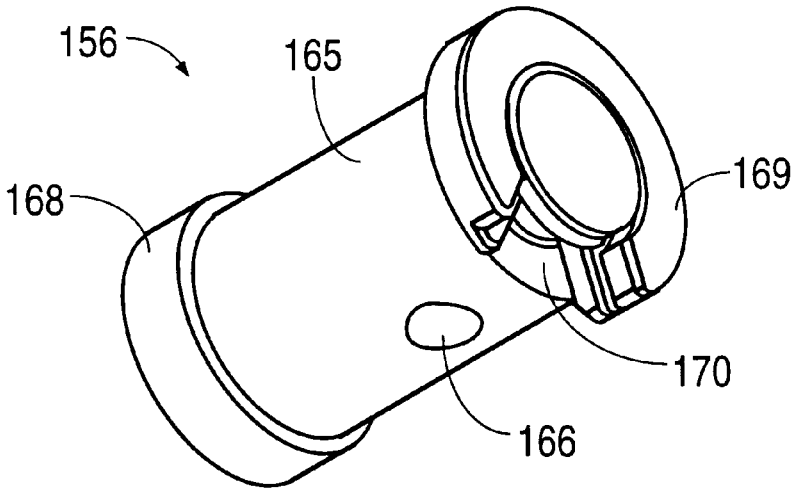

Additional detail of valve 156 is shown in FIGS. 21A and 21B. In the preferred embodiment, valve 156 consists of a hollow shaft portion 165 having a hole 166 formed in the side of shaft portion 165 and an opening 167 in the top of shaft portion 165. A first rib 168 limits the downward travel of valve 156 into the syringe chamber 153. A clip 169 is resiliently secured to the end of shaft portion 165 around an annular notch 170 formed in shaft portion 165 to limit the upward travel of valve 156 out of the syringe chamber 153. Clip 169 may be formed of high density polyethylene (HDPE), polycarbonate, or other suitable material. An annular recess 171 is formed near the top of valve 156 in which seats rib 96 (FIG. 10A) on valve 24 when the two valves are engaged. In the preferred embodiment, the length of valve 156 is 0.423 inches; however, an acceptable range may be approximately 0.25 to 1.0 inch depending on design factors such as ergonomics and reliability. The outer diameter of valve 156 is approximately 0.206 inches but can be virtually any diameter.

Additional detail of syringe 150 will be presented below while describing its use in transferring ink to print cartridge 16 and providing the proper back pressure (or negative pressure) within ink bag 51.

Figure 22:
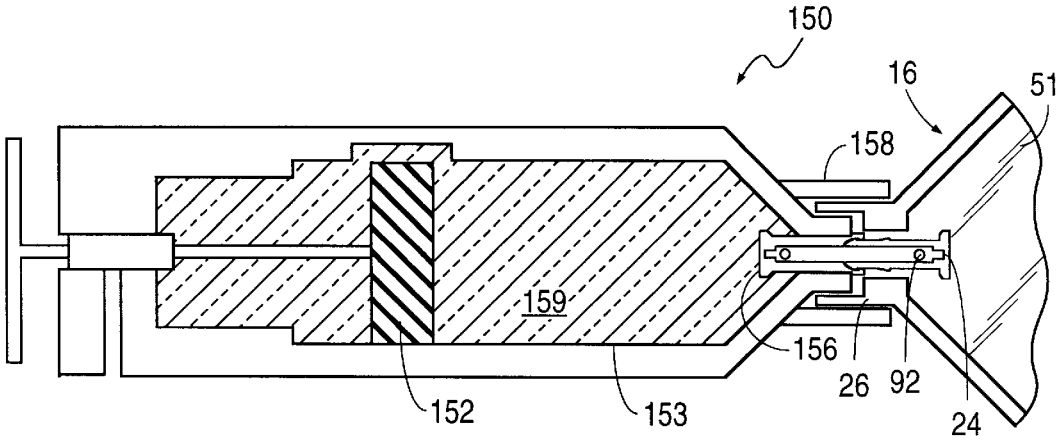
FIG. 22 illustrates the syringe of FIG. 20 with its valve connected to the print cartridge of FIG. 3.

FIG. 22 shows syringe 150 with its valve 156 mechanically and fluidly coupled to valve 24 on print cartridge 16. Both valves 156 and 24 are in their opened states. Cylindrical sleeves 158 and 26 are shown engaged, which maintains syringe 150 in the proper alignment with respect to print cartridge 16 during the recharging process. As will be described later with respect to FIGS. 27 through 30, the valves 156 and 24 are opened and closed automatically upon engagement and disengagement of syringe 150 and print cartridge 16.

Figure 23:
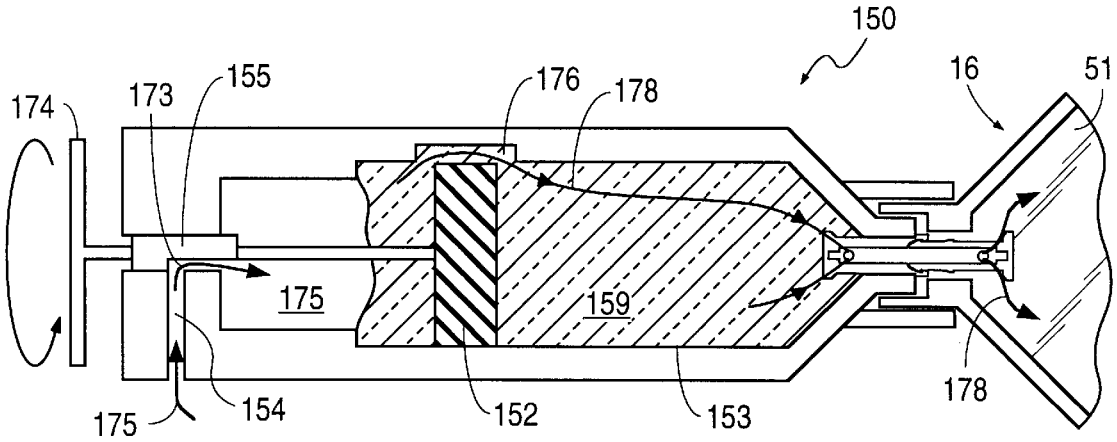
FIG. 23 illustrates the syringe of FIG. 22 as ink is being drawn into the print cartridge by the negative pressure of the print cartridge ink bag.

Fluid communication now exists between ink chamber 153 and ink bag 51. Although a negative pressure exists in ink bag 151 due the sidewalls of ink bag 51 being urged apart by an internal spring, ink 159 cannot be drawn from chamber 153 into ink bag 51 until plunger handle 174 is turned (FIG. 23) to align an opening 173 in valve 155 with air hole 154. This allows air 175 to fill any void in chamber 153 as ink 159 is drawn into ink bag 51. Ink 159 behind plunger 152 flows around plunger 152 through a flow recess 176. The flow of ink is illustrated by arrows 178. To prevent ink leaking through air hole 154, handle 174 should be at a higher elevation than the rest of syringe 150.

Figure 24:
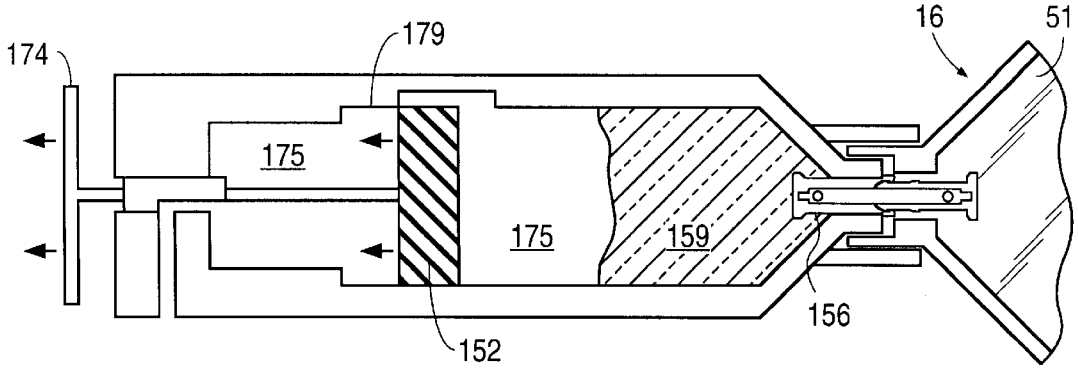
FIGS. 24 and 25 illustrate the syringe of FIG. 23 with the handle being pulled back to create a back pressure in the ink bag after recharging the print cartridge.

The ink in chamber 153 is drawn into ink bag 51 until ink bag 51 is full, at which time the flow of ink automatically stops. At this point, the springs that urge ink bag 51 outward are fully expanded against the side covers. Ink bag 51 is then substantially at atmospheric pressure, and a negative pressure must be created to prevent ink drool from the nozzles in the printhead portion of print cartridge 16. To this end, as shown in FIG. 24, handle 174 is pulled back, causing plunger 152 to create an airtight seal against a narrowed cylindrical wall portion 179. Upon creation of this seal, any further pull of handle 174 causes ink to now be withdrawn from ink bag 51, compressing the internal spring in ink bag 51 and creating a negative pressure within ink bag 51.

Figure 25:
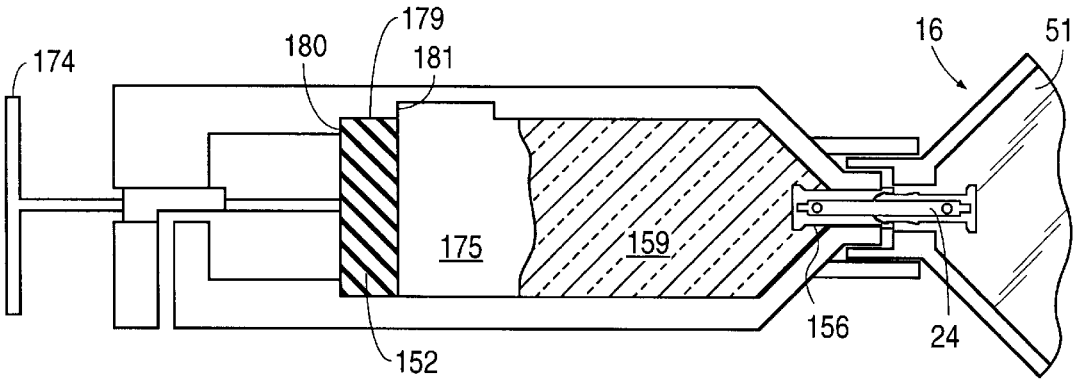
Figure 26:
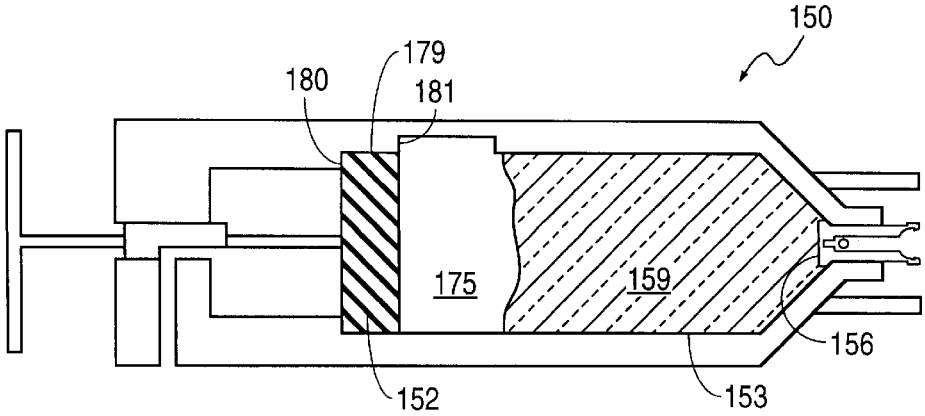
FIG. 26 illustrates the syringe of FIG. 25 after being disconnected from the print cartridge.

As shown in FIG. 25, a plunger stop 180 restricts further pulling of handle 174 to thus set the negative pressure in ink bag 51 to a predetermined amount, previously identified. The distance between the start 181 of the narrowed cylindrical wall portion 179 and the plunger stop 180 multiplied by the cross-sectional area of the narrowed cylindrical wall portion 179 equals the volume of ink extracted from print cartridge 16 when the handle 174 is pulled back. This volume is compensated by the motion of the walls of ink bag 51, pulling the springs far enough off of the side covers to assure proper backpressure.

Syringe 150 is then pulled away from print cartridge 16, causing valves 156 and 24 to automatically close to provide a fluid seal of ink bag 51 and chamber 153.

Figure 27:
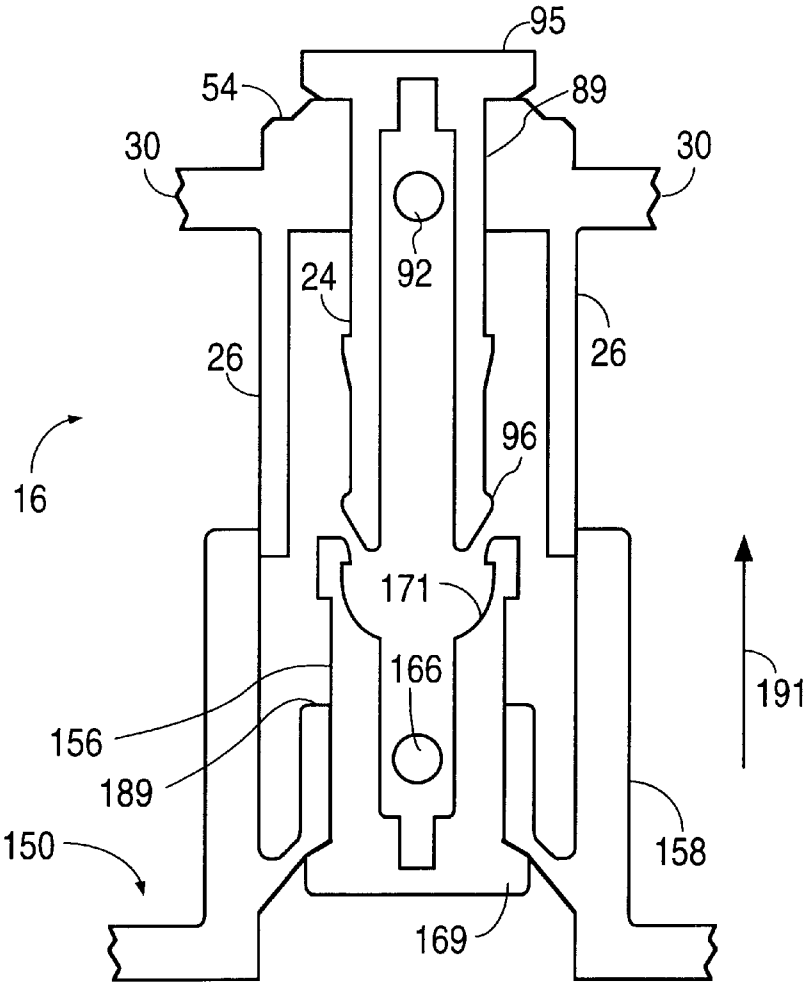

The engagement of valves 24 and 156 and the opening and closing of valves 24 and 156 are described with respect to FIGS. 27–30. In FIG. 27, print cartridge 16 and syringe 150 have not yet been engaged, and both valves 24 and 156 are in a closed position. More specifically, hole 92 in slideable valve 24, which leads to a middle bore in valve 24, is fully blocked by a surrounding seal 89 formed by inner frame 54, best shown in FIG. 9. The top portion of valve 24 is in direct contact with ink within the ink bag 51 (FIG. 7) in print cartridge 16. Valve 156 in syringe 150 is similarly shown in a closed state with the ink in chamber 153 contacting the bottom portion of valve 156. A seal 189 surrounds valve 156 and blocks hole 166.

Syringe 150 is shown being moved toward print cartridge 16 in a direction indicated by arrow 191, and sleeve 26 on print cartridge 16 is about to slide within sleeve 158 on syringe 150.

Figure 28:
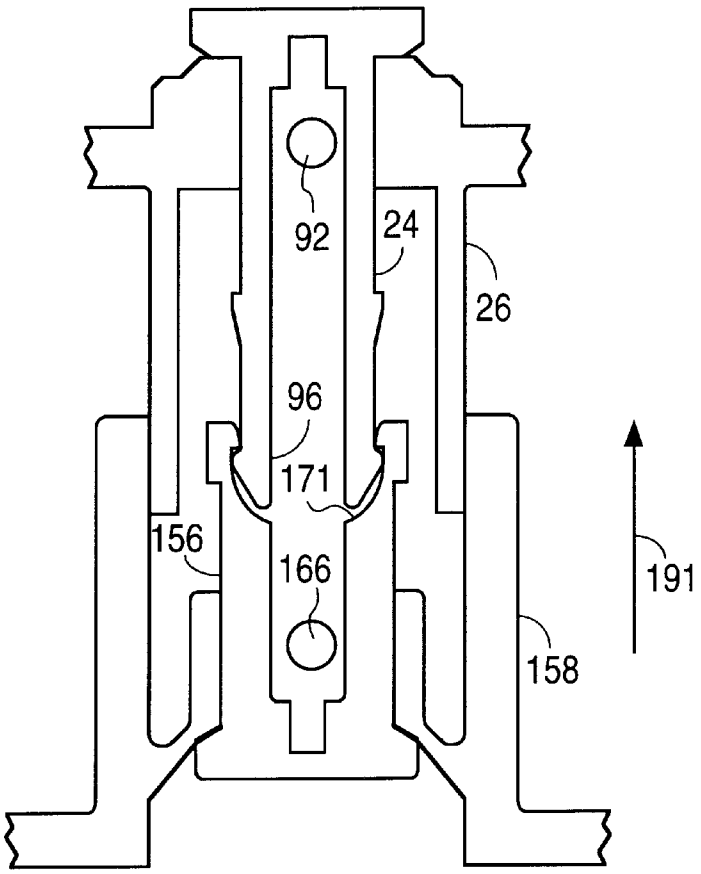
FIGS. 27, 28, 29 and 30 illustrate various positions of the valves as the print cartridge and syringe are engaged and then disengaged.

As shown in FIG. 28, rib 96 near the tip of valve 24 has now engaged the recess 171 in valve 156 to mechanically couple valves 24 and 156 together in a fluid tight seal. The friction between valve 24 and inner frame 54 and the friction between valve 156 and seal 189 is sufficiently high so that rib 96 engages recess 171 before valves 24 and 156 slide into their open positions. Some overtravel is allowed by rib 96 within recess 171 to provide an additional tactile feedback to the user indicating that the valves 24 and 156 are now engaged.

Cylindrical sleeve 26 on print cartridge 16 is now engaging cylindrical sleeve 158 on syringe 150 to ensure that valves 24 and 156 are centered with respect to one another as well as to limit the side-to-side movement of print cartridge 16 relative to syringe 150.

Figure 29:
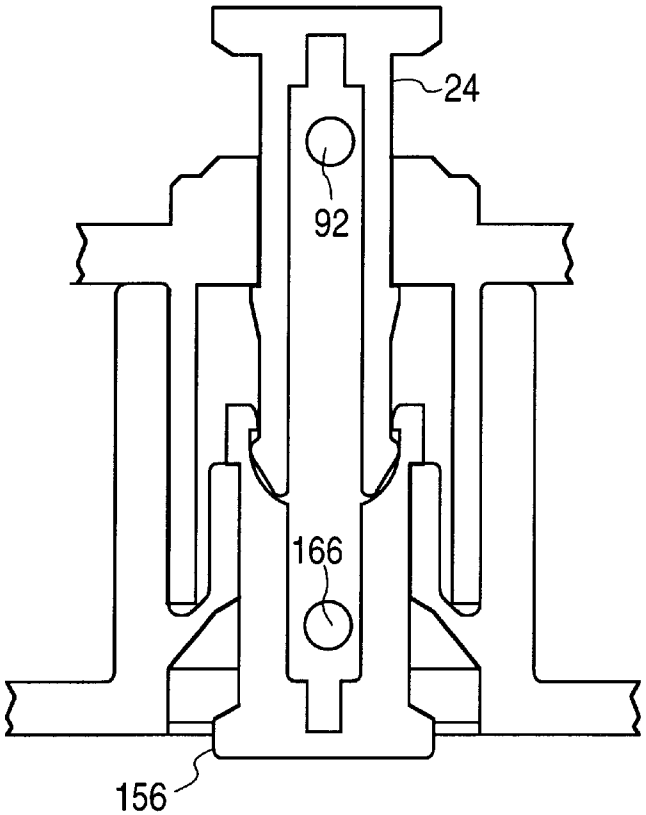

In FIG. 29, upon further force of print cartridge 16 against syringe 150, valve 156 slides open so that hole 166 is now within chamber 153. This same movement also causes valve 24 to now slide into its open position so that hole 92 is now within the ink bag 51 (FIG. 7) in print cartridge 16. A fluid channel now exists between chamber 153 and the negative pressure ink bag 51 within print cartridge 16.

The negative pressure in ink bag 51 draws ink from chamber 153 into ink bag 51 to fill the ink bag 51 as previously described. This process is relatively slow due to the low negative pressure and may take on the order of one to three minutes.

Figure 30:
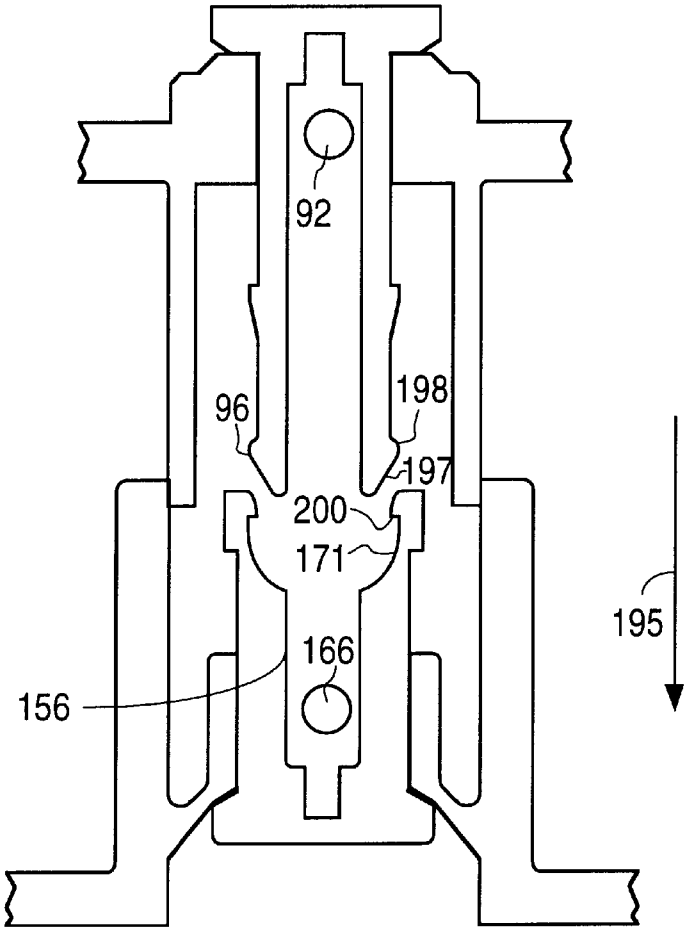

Once the ink bag 51 in print cartridge 16 is full, syringe 150 is then removed from print cartridge 16, as illustrated in FIG. 30, in the direction of arrow 195. In FIG. 30, the removal of syringe 150 closes valve 156 and valve 24 to thus seal off ink bag 51 in print cartridge 16. Further lifting causes valves 24 and 156 to become disengaged from one another.

As seen in FIGS. 27–30, valves 24 and 156 mechanically engage prior to opening and mechanically disengage after being closed upon removal of syringe 150 from print cartridge 16. This is accomplished by forming the rib 96 on valve 24 such that it is engageable with recess 171 with less force than it takes to disengage rib 96 from recess 171. This may be achieved by forming the bottom portion 197 (FIG. 30) of rib 96 to have a slight angle (e.g., 300) with respect to the axis of valve 24 to more easily enter through the opening in valve 156 and engage recess 171. The top portion 198 (FIG. 30) of rib 96 is then formed to have a steeper angle (e.g., 600) with respect to the axis of valve 24 to make it more difficult to disengage rib 96 from recess 171. Additionally, recess 171 may be formed to have a more horizontal upper lip 200 (FIG. 30) so as to make it more difficult to disengage rib 96 from recess 171 than to engage rib 96 and recess 171. Other ways of providing such relative forces may be used instead of the two techniques described herein.

In alternative embodiments, other techniques are used to increase the reliability that valves 24 and 156 have engaged prior to the valves being opened or have closed after a recharge. Such techniques include increasing the sliding force of valves 24 and 156, spring loading valves 34 and 156 to ensure they are closed after the print cartridge 16 has been removed from syringe 150, and forming a tab near sleeve 158 which temporarily impedes the motion of syringe 150, then releases, to increase the acceleration of syringe 150 toward print cartridge 16 before valves 24 and 156 have been engaged.

If print cartridge 16 were optionally removed from carriage 18 (FIG. 1), print cartridge 16 is then reinserted into carriage 18.

In the preferred embodiment, the inkjet printer 10 (FIG. 1) includes an automatic service station which creates a seal over nozzles 44 (FIG. 3) and primes the printhead using a vacuum pump. This withdrawing of ink from ink bag 51 ensures that ink is now in the ink ejection chambers in the printhead ready for firing.

Accordingly, a preferred rechargeable inkjet print cartridge has been described along with an ink refill system and method for recharging the print cartridge with the refill system. Other types of valves and seals may be used to perform the automatic opening and closing function of the preferred valves, and such alternative embodiments are envisioned in this invention.

Alternative Embodiment Refill System

Other embodiments using the concepts described with respect to syringe 150 may be used to recharge print cartridge 16 and then draw a negative pressure within ink bag 51.

Figure 31:
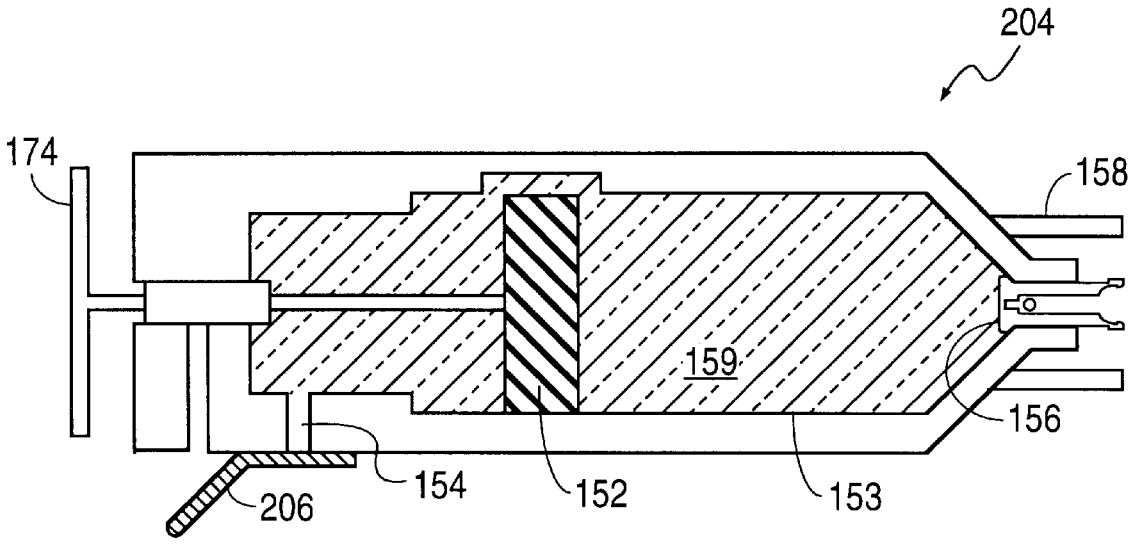
FIG. 31 is a cross-sectional view of an alternative embodiment syringe.

FIG. 31 shows another embodiment of a syringe 204 which is virtually identical to syringe 150 in FIG. 20 except that, instead of air intake valve 155 being used to selectively allow air to be introduced into chamber 153 through air hole 154, a simple adhesively-fixed pull tab 206 is provided over air hole 154. Tab 206 is removed at the appropriate time to allow ink bag 51 to draw ink from chamber 153.

Figure 32:
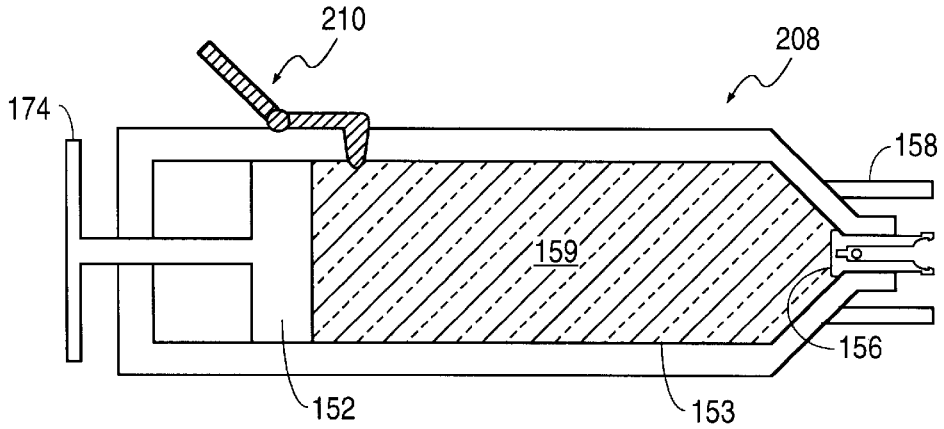
FIGS. 32, 33 and 34 are cross-sectional views of yet another embodiment syringe in its initial state (FIG. 32), while recharging a print cartridge (FIG. 33), and creating a back pressure in the print cartridge after recharging (FIG. 34).
Figure 33:
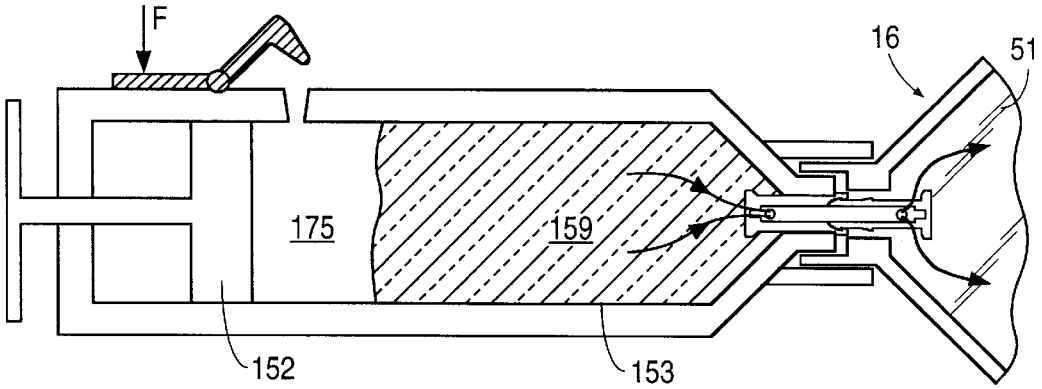
Figure 34:
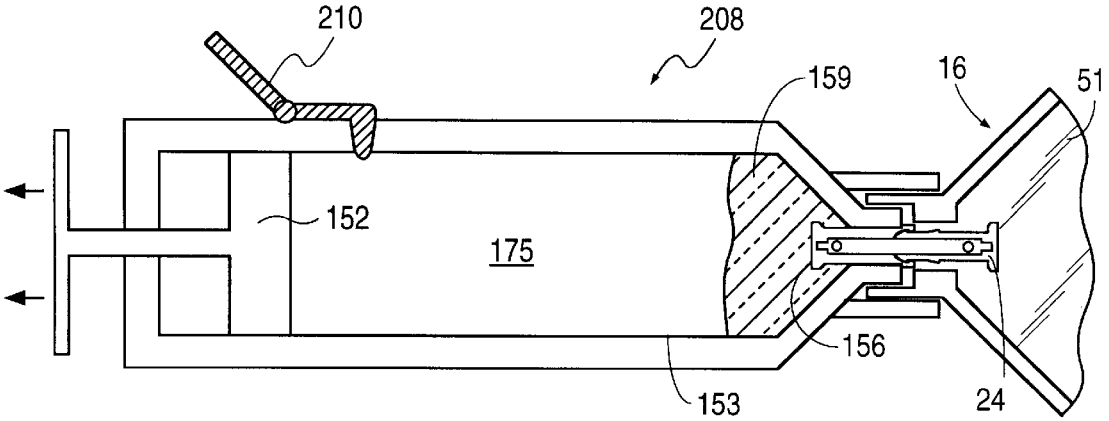

FIGS. 32, 33, and 34 illustrate the use of another type of syringe 208 which employs the concepts described with respect to syringe 150 in FIG. 20. Syringe 208 has a spring-loaded seal 210 which, when manually opened (FIG. 33), allows air to enter chamber 153 so that ink may be drawn into ink bag 51 by the negative pressure within ink bag 51.

As shown in FIG. 34, after recharging print cartridge 16, the spring-loaded seal 210 is again closed, and plunger 152 is pulled back to withdraw a predetermined quantity of ink from ink bag 51 to create the initial back pressure in print cartridge 16. In additional alternative embodiments, spring-loaded seal 210 could be a piece of adhesive tape that is removed and replaced or some other simple means of opening and closing the air vent. Syringe 208 is then withdrawn from print cartridge 16, thus closing both valves 24 and 156.

Figure 35:
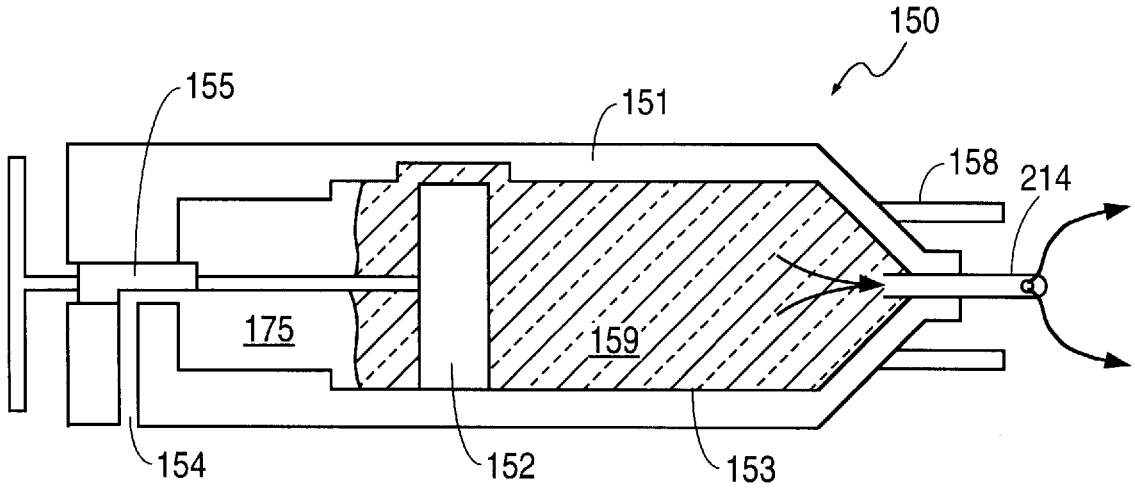
FIG. 35 is a cross-sectional view of another embodiment syringe using a hollow needle instead of a slideable valve.

In the embodiments of FIGS. 20, 31 and 32, valve 156 may be replaced, as shown in FIG. 35, by a hollow needle 214 having an opening at both ends.

This needle portion of the syringe may be conventional. The recharge port of the print cartridge 16 would, instead of incorporating valve 24, incorporate a conventional rubber septum having a sealable slit through its middle. Needle 214 on syringe 150 would then be inserted through the septum to form an airtight fluid connection between chamber 153 and ink bag 51. Ink transference and the creation of back pressure in ink bag 51 would be performed using the techniques shown with respect to FIGS. 20–34. When needle 214 is removed from the septum, the central slit in the septum automatically reseals ink bag 51.

Conclusion

While particular embodiments of the prevent invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. For example, although a negative pressure ink bag is described, a negative pressure ink bag may not be necessary. The ink bag in print cartridge 16 will be refilled as long as chamber 153 in syringe 150 is at a pressure greater than the pressure in the ink bag. Such a pressure differential may be obtained by providing chamber 153 with an internal positive pressure. Positive pressure may be achieved using any suitable technique.

Additionally, recharging a print cartridge through its initial ink fill port 47 is also envisioned using the above-described techniques. In such an embodiment, any stopper or septum for fill port 47 is removed or penetrated, and the syringe tip is inserted into fill port 47 to create an airtight seal.

What is claimed is:

1. A method for recharging a print cartridge reservoir with ink while said print cartridge is installed in an inkjet printer comprising:

providing a print cartridge in a scanning carriage in an inkjet printer, said print cartridge having an ink recharge port;

connecting an ink outlet port of a syringe to said recharge port on said print cartridge while said print cartridge is provided in said scanning carriage, said step of connecting creating an airtight fluid path between a chamber of said syringe and said reservoir within said print cartridge;

allowing ambient air to enter said chamber while ink within said chamber is drawn into said reservoir by a negative pressure in said reservoir relative to a pressure in said chamber;

pulling back on a plunger within said chamber, after said reservoir is sufficiently recharged with ink, to withdraw an amount of ink from said reservoir to create a desired negative pressure within said reservoir; and sealing said recharge port of said print cartridge, while said reservoir is at said negative pressure, to prevent air ingestion into said reservoir.

2. The method of claim 1 wherein said step of sealing said recharge port comprises the step of removing said ink outlet port from said recharge port to automatically seal said recharge port.

3. The method of claim 1 wherein said step of connecting comprises the step of connecting a slideable first valve on said syringe to a slideable second valve on said print cartridge to provide an airtight fluid connection between said chamber and said reservoir.

4. The method of claim 1 wherein said recharge valve is located within a handle of said print cartridge, said handle facilitating insertion of said print cartridge into said carriage and removal of said print cartridge from said carriage.

5. The method of claim 1 wherein said step of allowing ambient air to enter said chamber comprises turning said plunger to create an air communication path between an air hole in a body of said syringe and said chamber.

6. The method of claim 1 wherein said step of allowing ambient air to enter said chamber comprises removing a tab over an air hole in said syringe to create an air communication path between said air hole and said chamber.

7. The method of claim 1 wherein said step of allowing ambient air to enter said chamber comprises moving a lever covering an air hole in said syringe to create an air communication path between said air hole and said chamber.

8. The method of claim 1 wherein said chamber has a narrowed cylindrical wall portion, which creates a fluid seal with said plunger, and an expanded inner cylindrical wall portion which allows ink to flow around said plunger to said ink outlet port, said plunger being located within said expanded inner cylindrical wall portion while said ink is drawn into said reservoir, said step of pulling back on said plunger comprising pulling back on said plunger so that said plunger is located within said narrowed cylindrical wall portion.

9. The method of claim 8 wherein said chamber has an internal stop for said plunger to limit a range of movement of said plunger away from said ink outlet port.

10. The method of claim 1 wherein said ink outlet port comprises a hollow needle in fluid communication with said chamber.

11. A method for recharging a print cartridge reservoir with ink comprising:

removing a print cartridge from a scanning carriage in an inkjet printer, said print cartridge having an ink recharge port;

connecting an ink outlet port of a syringe to said recharge port on said print cartridge while said print cartridge is removed from said scanning carriage, said step of connecting creating an airtight fluid path between a chamber of said syringe and said reservoir within said print cartridge;

allowing ambient air to enter said chamber while ink within said chamber is drawn into said reservoir by a negative pressure in said reservoir relative to a pressure in said chamber;

pulling back on a plunger within said chamber, after said reservoir is sufficiently recharged with ink, to withdraw an amount of ink from said reservoir to create a desired negative pressure within said reservoir; and sealing said recharge port of said print cartridge, while said reservoir is at said negative pressure, to prevent air ingestion into said reservoir.

12. The method of claim 11 wherein said step of sealing said recharge port comprises the step of removing said ink outlet port from said recharge port to automatically seal said recharge port.

13. The method of claim 11 wherein said step of connecting comprises the step of connecting a slideable first valve on said syringe to a slideable second valve on said print cartridge to provide an airtight fluid connection between said chamber and said reservoir.

14. The method of claim 11 wherein said recharge valve is located within a handle of said print cartridge, said handle facilitating insertion of said print cartridge into said carriage and removal of said print cartridge from said carriage.

15. The method of claim 11 wherein said step of allowing ambient air to enter said chamber comprises turning said plunger to create an air communication path between an air hole in a body of said syringe and said chamber.

16. The method of claim 11 wherein said step of allowing ambient air to enter said chamber comprises removing a tab over an air hole in said syringe to create an air communication path between said air hole and said chamber.

17. The method of claim 11 wherein said step of allowing ambient air to enter said chamber comprises moving a lever covering an airhole in said syringe to create an air communication path between said air hole and said chamber.

18. The method of claim 11 wherein said chamber has a narrowed cylindrical wall portion, which creates a fluid seal with said plunger, and an expanded inner cylindrical wall portion which allows ink to flow around said plunger to said ink outlet port, said plunger being located within said expanded inner cylindrical wall portion while said ink is drawn into said reservoir, said step of pulling back on said plunger comprising pulling back on said plunger so that said plunger is located within said narrowed cylindrical wall portion.

19. The method of claim 18 wherein said chamber has an internal stop for said plunger to limit a range of movement of said plunger away from aid ink outlet port.

20. The method of claim 11 wherein said ink outlet port comprises a hollow needle in fluid communication with said chamber.

* * * * *

UNITED STATES PATENT AND TRADEMARK OFFICE

CERTIFICATE OF CORRECTION

PATENT NO. : 5,992,987

DATED : November 30, 1999

INVENTOR(S) : Winthrup D. Childers,et al.

It is certified that error appears in the above-identified patent and that said Letters Patent is hereby corrected as shown below:

At Column 16, line 3, after "from", delete "aid" and insert in lieu thereof--said--.

Signed and Sealed this

Second Day of January, 2001

*Attest:*

*Attesting Officer*

Q. TODD DICKINSON

*Commissioner of Patents and Trademarks*